US009802421B2

(12) United States Patent
Miyamoto

(10) Patent No.: US 9,802,421 B2
(45) Date of Patent: Oct. 31, 2017

(54) LIQUID DROPLET EJECTING METHOD AND LIQUID DROPLET EJECTING APPARATUS

(71) Applicant: Seiko Epson Corporation, Tokyo (JP)

(72) Inventor: Toru Miyamoto, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/067,535

(22) Filed: Mar. 11, 2016

(65) Prior Publication Data

US 2016/0271935 A1 Sep. 22, 2016

(30) Foreign Application Priority Data

Mar. 19, 2015 (JP) ..... 2015-055785
Mar. 23, 2015 (JP) ..... 2015-059150

(51) Int. Cl.
*B41J 2/21* (2006.01)

(52) U.S. Cl.
CPC ..... *B41J 2/2132* (2013.01)

(58) Field of Classification Search
CPC ..... B41J 2/2132
See application file for complete search history.

(56) References Cited

U.S. PATENT DOCUMENTS 5,946,011 A 8/1999 Kanaya
2002/0154182 A1* 10/2002 Takahashi ..... B41J 2/2132 347/12

FOREIGN PATENT DOCUMENTS

JP 06-047925 A 2/1994
JP 10-323978 A 12/1998
JP 2002-307672 A 10/2002
JP 2011-245703 A 12/2011

* cited by examiner

*Primary Examiner* — Jason Uhlenhake
(74) *Attorney, Agent, or Firm* — Harness, Dickey & Pierce, P.L.C.

(57) ABSTRACT

A liquid droplet ejecting method which includes forming an image which is configured by a raster which is completed using liquid droplet ejecting operations of n times by alternately repeating a transport operation, and a liquid droplet ejecting operation in which liquid droplets are ejected on the medium while moving a first head which includes a plurality of nozzles, and a second head which aligns on the upstream side of the first head, in a scanning direction which intersects the transport direction in a scanning manner, in which, in a liquid droplet ejecting operation after a liquid droplet ejecting operation in which a first nozzle column and a second nozzle column are used in one liquid droplet ejecting operation, the number of times m (blank time) in which a liquid droplet ejecting operation of not using the second nozzle column is continuously executed is less than 0.5n.

10 Claims, 20 Drawing Sheets

LIQUID DROPLET EJECTING METHOD AND LIQUID DROPLET EJECTING APPARATUS

BACKGROUND

1. Technical Field

The present invention relates to a liquid droplet ejecting method and a liquid droplet ejecting apparatus.

2. Related Art

As an example of the liquid droplet ejecting apparatus, an ink jet printer which performs printing (recording) of an image by ejecting liquid droplets (ink droplets) onto various printing media such as paper, or a film, has been known. The ink jet printer alternately repeats a dot forming operation in which ink droplets are ejected from each nozzle, while moving (scanning) a head, in which a plurality of nozzles are formed, in a scanning direction with respect to a printing medium, and a transport operation in which the printing medium is moved (transported) in a transport direction which intersects the scanning direction, forms dots which are aligned in the scanning direction (dot column) in line in the transport direction, and forms an image on the printing medium.

In such an ink jet printer, as one method of further increasing a printing speed, a method of increasing the number of nozzles has been adopted. Specifically, in the method, a printing speed is increased by increasing the number of dots which is ejected in one scanning, by increasing the number of nozzles per head, or by aligning a plurality of heads. Forming of an image in a region with a width corresponding to a length of a column which is formed of a plurality of nozzles (plurality of heads) (band) is finished using one scanning, transporting of a printing medium in the transport direction is performed corresponding to the width, subsequently, and a band is formed by aligning an end portion of the band which is formed, and an end portion of a band which is formed by the subsequent scanning in the transport direction so that the end portions come into contact with each other. By repeating this process, an image is formed. It is possible to perform printing at a high speed using the method; however, in the method, there is a case in which a striped pattern (banding) occurs at a boundary of the band. This is caused by a variation in sending accuracy in the transport direction, a difference in ink ejecting properties at a switching portion of a nozzle column (variation in landing position of ink droplets, a variation in amount of ink droplets), or the like.

In JP-A-6-47925, as a method of suppressing deterioration in image quality due to the banding, a method in which a variation in ejecting properties or ejecting accuracy of an ejecting port is dispersed has been proposed. Specifically, as the simplest example, there is a method in which a part of dots in a lower end region of a band which is firstly formed, and a part of dots in an upper end region of a band which is subsequently formed are formed so as to overlap in the same region, by causing the lower end region of the band which is formed along with scanning of a head, and the upper end region of the band which is formed along with the subsequent scanning of the head to overlap. In addition, in JP-A-10-323978, a method in which a high quality image is formed using a plurality of nozzle columns has been proposed.

However, in a case in which an amount of ink droplets which are ejected is set to be small, and the number of dots for forming an image is increased in order to obtain a high definition image, there is a problem in that banding may occur due to a difference in timing at which ink droplets are ejected. Since a degree of dryness varies according to a passage of time after landing of ink droplets in plurality of adjacent dots which form an image, there is a difference in degree of bleeding, or a difference in shape on the surface as a result, due to a degree of dryness of surrounding ink droplets which previously landed and new ink droplets which land on the adjacent positions. For this reason, in a case of forming an image in a certain region, when a distribution of time interval in landing of a plurality of ink droplets for forming an image (respective pixels) is remarkably different from that in another adjacent region, there is a difference in degree of bleeding, or a difference in shape on the surface of the ink droplets, and as a result, a visually recognized unevenness (for example, uneven glossiness) occurs. In particular, in the upper end region or the lower end region of a printing medium, there is a case in which a region in which the distribution of ink droplet landing time is different is generated due to the necessity for performing a switching control of a head which is used, and as a result, banding occurs.

SUMMARY

The invention can be realized in the following aspects or application examples.

Application Example 1

According to this application example, there is provided a liquid droplet ejecting method which includes forming an image which is configured by a unit of image which is completed using liquid droplet ejecting operations of n times by repeating a plurality of times of a transport operation in which a printing medium is moved in a transport direction and a liquid droplet ejecting operation in which liquid droplets are ejected on the printing medium while moving a first nozzle column which includes a plurality of nozzles which are aligned in the transport direction, and eject liquid droplets, and a second nozzle column which aligns on the upstream side of the first nozzle column in the transport direction, and includes a plurality of nozzles which are aligned in the transport direction, and eject liquid droplets in a scanning direction which intersects the transport direction in a scanning manner, in which the number of times m in which the liquid droplet ejecting operation, in which the second nozzle column is not used, is continuously executed after executing the liquid droplet ejecting operation once using the first nozzle column and the second nozzle column, is less than 0.5n.

In the liquid droplet ejecting method according to the application example, an image is formed by alternately repeating the transport operation in which a printing medium is moved in the transport direction, and the liquid droplet ejecting operation in which liquid droplets are ejected onto the printing medium while causing the first nozzle column and the second nozzle column to be moved in the scanning direction which intersects the transport direction in a scanning manner. The first nozzle column and the second nozzle column include a plurality of nozzles which are aligned in the transport direction, and the second nozzle column is aligned on the upstream side of the first nozzle column in the transport direction. In addition, in the liquid droplet ejecting method in the application example, an image configured by a unit of image which is completed using liquid droplet ejecting operations of n times is formed. In addition, n is a natural number.

According to the application example, in a liquid droplet ejecting operation after a liquid droplet ejecting operation in which the first nozzle column and the second nozzle column are used in one liquid droplet ejecting operation, the number of continuous times in which a liquid droplet ejecting operation not using the second nozzle column is less than 0.5n times. In other words, there is no case in which a blank time, in which the second nozzle column is not continuously used, becomes a long time which is 0.5n times of a liquid droplet ejecting operation or more. As a result, since a degree of dryness of ejected liquid droplets during the blank time is reduced, it is possible to suppress printing unevenness which occurs due to a difference in the degree of dryness.

Application Example 2

In the liquid droplet ejecting method according to the application example, $(m1-m2)/m0<1$ may be satisfied when a mean value, a maximum value, and a minimum value of the number of times m are set to m0, m1, and m2.

According to the application example, $(m1-m2)/m0<1$ is satisfied when a mean value, a maximum value, and a minimum value of the number of times m of the liquid droplet ejecting operation in which the second nozzle column is not continuously used are set to m0, m1, and m2. That is, a change thereof is suppressed so that a difference in the number of times of the liquid droplet ejecting operation in which the second nozzle column is not continuously used does not exceed the mean value m0 of the number of times m at most. As a result, since a difference (variation) in blank time in which the second nozzle column is not continuously used is reduced, and a difference in degree of dryness of ejected liquid droplets during the blank time is reduced, it is possible to further suppress printing unevenness which occurs due to the difference in degree of dryness.

Application Example 3

According to this application example, there is provided a liquid droplet ejecting method which includes transporting in which a printing medium is moved in a transport direction; scanning in which a first nozzle column and a second nozzle column which include a plurality of nozzles which eject liquid droplets, and are arranged at positions which are different along the transport direction are moved in one direction along a scanning direction which intersects the transport direction; ejecting in which liquid droplets are ejected from the first nozzle column and the second nozzle column; and non-ejecting in which liquid droplets are not ejected from at least any one of the first nozzle column and the second nozzle column, in which it is possible to execute the non-ejecting while executing the scanning accompanying the ejecting a plurality of times.

According to the application example, it is possible to control an interval in ejecting in which liquid droplets are ejected by combining ejecting (ejecting operation) in which liquid droplets are ejected from the first nozzle column and the second nozzle column, and non-ejecting (non-ejecting operation) in which liquid droplets are not ejected from at least any one of the first nozzle column and the second nozzle column, when performing scanning (scanning operation) in which the first nozzle column and the second nozzle column are moved in the scanning direction which intersects the transport direction. That is, it is possible to perform a control so that a difference in time in which liquid droplets ejected to a printing medium are dried, or a degree of change thereof, is reduced.

Application Example 4

In the liquid droplet ejecting method according to the application example, the non-ejecting may be executed only for a time which is taken in executing of the scanning.

According to the application example, non-ejecting is executed only for a time which is taken in executing of scanning. That is, since it is possible to control non-ejecting in a unit of time which is taken in scanning, there is no case in which a time in which liquid droplets ejected onto a printing medium dry varies in each scanning, and it is possible to perform a control so that a difference in time in which liquid droplets ejected to a printing medium are dried, or a degree of change thereof, is reduced.

Application Example 5

In the liquid droplet ejecting method according to the application example, the non-ejecting may be executed accompanied with the scanning.

According to the application example, the non-ejecting is executed accompanied with the scanning. That is, since scanning in which the first nozzle column and the second nozzle column are moved along the scanning direction which intersects the direction in which a printing medium is transported is accompanied even in the non-ejecting, it is possible to perform the non-ejecting without considering that a printing apparatus is malfunctioning, or has a problem, due to stopping of a movement of the nozzle column along the scanning direction.

Application Example 6

In the liquid droplet ejecting method according to the application example, in the non-ejecting, liquid droplets may not be ejected from the first nozzle column and the second nozzle column.

According to the application example, in the non-ejecting, liquid droplets are not ejected from the first nozzle column and the second nozzle column. That is, since it is possible to perform a control so that a difference in time in which liquid droplets ejected to a printing medium are dried, or a degree of change thereof, is reduced using switching of ejecting and non-ejecting, the control becomes convenient.

Application Example 7

In the liquid droplet ejecting method according to the application example, informing of a fact that a predetermined operation is being executed may be performed during executing of the non-ejecting.

According to the application example, informing of performing of a non-ejecting operation during a non-ejecting operation is performed using sound, or by displaying on a panel, for example. For this reason, it is possible to easily recognize that the operation of not ejecting liquid droplets is a predetermined operation.

Application Example 8

According to this application example, there is provided a liquid droplet ejecting apparatus which includes a transport unit which moves a printing medium in a transport direction;

a first nozzle column which includes a plurality of nozzles which align in the transport direction, and eject liquid droplets; a second nozzle column which aligns on the upstream side of the first nozzle column in the transport direction, and includes a plurality of nozzles which align in the transport direction, and eject liquid droplets; and a scanning movement unit which moves the first nozzle column and the second nozzle column in a scanning direction which intersects the transport direction in a scanning manner, in which an image configured of a raster which is completed using liquid droplet ejecting operations of n times is formed, by alternately repeating a transport operation in which the printing medium is moved in the transport direction, and a liquid droplet ejecting operation in which liquid droplets are ejected onto the printing medium while causing the first nozzle column and the second nozzle column to be moved in a scanning manner, and in the liquid droplet ejecting operation after the liquid droplet ejecting operation in which the first nozzle column and the second nozzle column are used in the liquid droplet ejecting operation of one time, the number of times m, in which the liquid droplet ejecting operation in which the second nozzle column is not used is continuous, is less than 0.5n.

The liquid droplet ejecting apparatus according to the application example includes the transport unit which moves a printing medium in the transport direction; the first nozzle column which includes the plurality of nozzles which align in the transport direction, and eject liquid droplets; the second nozzle column which aligns on the upstream side of the first nozzle column in the transport direction, and includes the plurality of nozzles which align in the transport direction, and eject liquid droplets; and the scanning movement unit which moves the first nozzle column and the second nozzle column in the scanning direction which intersects the transport direction in a scanning manner. In addition, the liquid droplet ejecting apparatus forms an image configured of a raster which is completed using the liquid droplet ejecting operations of n times, by alternately repeating the transport operation in which the printing medium is moved in the transport direction, and the liquid droplet ejecting operation in which liquid droplets are ejected onto the printing medium while causing the first nozzle column and the second nozzle column to be moved in a scanning manner.

According to the application example, in a liquid droplet ejecting operation after a liquid droplet ejecting operation in which the first nozzle column and the second nozzle column are used in a liquid droplet ejecting operation of one time, the number of times in which a liquid droplet ejecting operation in which the second nozzle column is not used is continuous is less than 0.5n. In other words, there is no case in which a blank time in which the second nozzle column is not continuously used becomes a long time which is 0.5n times or more of a liquid droplet ejecting operation. As a result, since a degree of dryness of ejected liquid droplets during the blank time is reduced, it is possible to suppress printing unevenness which occurs due to a difference in the degree of dryness.

Application Example 9

According to this application example, there is provided a liquid droplet ejecting apparatus which includes a transport unit which moves a printing medium in a transport direction; a first nozzle column and a second nozzle column which include a plurality of nozzles which eject liquid droplets, and are arranged at different positions along the transport direction; a scanning movement unit which moves the first nozzle column and the second nozzle column in a scanning direction which intersects the transport direction; and a control unit which controls ejecting and non-ejecting of liquid droplets from the first nozzle column and the second nozzle column, in which the control unit causes the first nozzle column and the second nozzle column to eject liquid droplets along with a movement of the first nozzle column and the second nozzle column in one direction along the scanning direction using the scanning movement unit, and can set a period in which at least any one of the first nozzle column and the second nozzle column is set to a non-ejecting state while the scanning movement unit moves the first nozzle column and the second nozzle column a plurality of times.

According to the application example, it is possible to control an interval of an ejecting operation in which liquid droplets are ejected, by combining an ejecting operation and a non-ejecting operation. That is, it is possible to perform a control so that a difference in time in which liquid droplets ejected to a printing medium are dried, or a degree of change thereof, is reduced.

Application Example 10

In the liquid droplet ejecting apparatus according to the application example, the first nozzle column and the second nozzle column may be included in different heads, respectively.

According to the application example, it is possible to perform a control so that a difference in time in which liquid droplets ejected to a printing medium are dried is reduced, between heads, or a degree of change thereof is reduced, by providing the first nozzle column and the second nozzle column in different heads, respectively.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments in which the invention is embodied will be described with reference to drawings. One embodiment of the invention will be described hereinafter, and the embodiment does not limit the invention. In addition, in each figure, there is a case in which elements are described using scales which are different from actual scales for ease of descriptions.

First Embodiment

Figure 1:
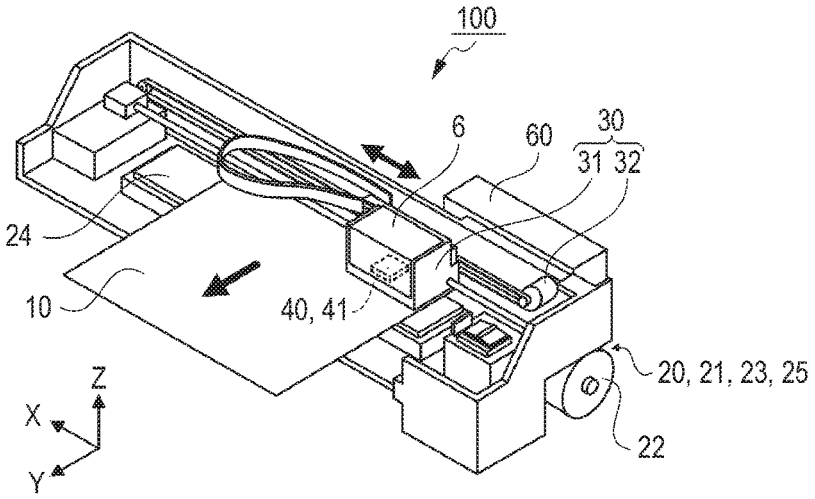
FIG. 1 is a perspective view which illustrates an internal configuration of an ink jet printer as a liquid droplet ejecting apparatus according to a first embodiment.
Figure 2:
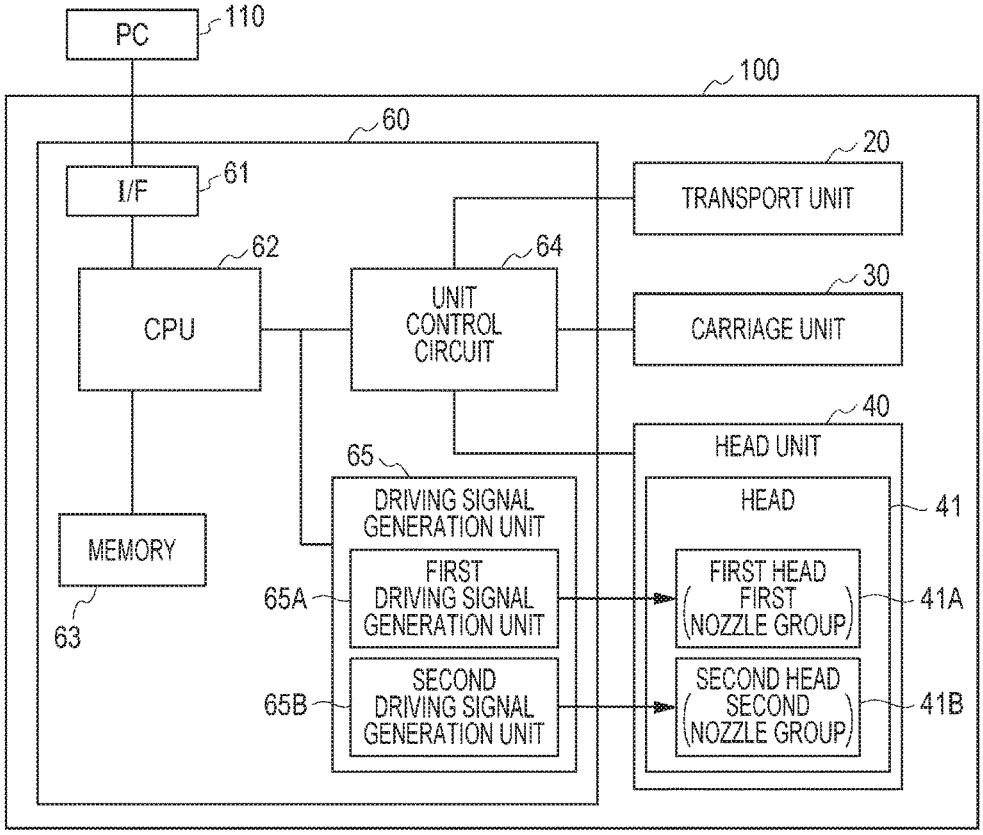
FIG. 2 is a block diagram which illustrates the entire configuration of the ink jet printer as the liquid droplet ejecting apparatus according to the first embodiment.

FIG. 1 is a perspective view which illustrates an internal configuration of an ink jet printer 100 as a liquid droplet ejecting apparatus according to a first embodiment, and FIG. 2 is a block diagram.

In addition, in XYZ axes which are added in figures, the ink jet printer 100 is provided on an X-Y plane. In addition, a +/−X direction (X axis direction) is described as a scanning direction which will be described later, a +Y direction is described as a transport direction which will be described later, and a Z direction is described as a height direction.

First, a basic configuration of the ink jet printer 100 will be described.

Basic Configuration of Ink Jet Printer

The ink jet printer 100 (hereinafter, referred to as printer 100) includes a transport unit 20 as a "transport portion", a carriage unit 30 as a "scanning movement unit", a head unit 40, and a controller 60. The printer 100 which receives printing data (image forming data) from a personal computer 110 (hereinafter, referred to as PC 110) as an external device controls each unit (transport unit 20, carriage unit 30, and head unit 40) using the controller 60. The controller 60 controls each unit based on printing data which is received from the PC 110, and prints an image (forms image) on a sheet 10 as a "printing medium".

The transport unit 20 has a function of moving the sheet 10 in a predetermined transport direction (+Y direction illustrated in FIG. 1). The transport unit 20 includes a sheet feeding roller 21, a transport motor 22, a transport roller 23, a platen 24, a sheet discharging roller 25, and the like. The sheet feeding roller 21 feeds the sheet 10 which is inserted from the rear face (−Y direction) of the printer 100 to the inside of the printer 100. The transport roller 23 transports the sheet 10 which is fed using the sheet feeding roller 21 to a region of the platen on the upper part in which printing can be performed. The platen 24 supports the sheet 10 which is being printed. The sheet discharging roller 25 discharges the sheet 10 to the front face (transport direction) of the printer. The sheet feeding roller 21, the transport roller 23, and the sheet discharging roller 25 are driven using the transport motor 22.

The carriage unit 30 has a function of reciprocating (scanning) a head 41 which will be described later in a predetermined movement direction (X axis direction illustrated in FIG. 1, and is referred to as scanning direction, hereinafter). The carriage unit 30 includes a carriage 31, a carriage motor 32, or the like. The carriage 31 can reciprocate in the scanning direction, and is driven by the carriage motor 32. In addition, the carriage 31 detachably holds an ink cartridge 6 which accommodates ink.

The head unit 40 has a function of ejecting ink as "liquid droplets" (hereinafter, also referred to as ink droplets) onto the sheet 10. The head unit 40 includes a head 41 which has a plurality of nozzles (nozzle columns). The head 41 is mounted on the carriage 31, and moves in the scanning direction along with a movement of the carriage 31 in the scanning direction. When the head 41 ejects ink droplets while moving in the scanning direction, a dot column (raster line) which goes along the scanning direction is formed on the sheet 10.

The head 41 includes two heads (first nozzle group 41A and second nozzle group 41B). A configuration of the head 41 will be described later.

The controller 60 is a control unit which control the entire printer 100. The controller 60 includes an interface unit 61, a CPU 62, a memory 63, a unit control circuit 64, or the like. The interface unit 61 performs transceiving of data between the PC 110 and the printer 100. The CPU 62 is an arithmetic processing device for controlling the entire printer 100. The memory 63 is a storage medium for securing a region for storing a program which is operated by the CPU 62, a work area for operation, or the like, and is configured of a storage element such as a RAM, and an EEPROM.

The CPU 62 controls each unit (transport unit 20, carriage unit 30, and head unit 40) through the unit control circuit 64 according to a program which is stored in the memory 63.

In addition, a driving signal generation unit 65 is provided in the controller 60. The driving signal generation unit 65 includes a first driving signal generation unit 65A and a second driving signal generation unit 65B. The first driving signal generation unit 65A generates a first driving signal for driving a piezoelectric element of the first nozzle group 41A. The second driving signal generation unit 65B generates a second driving signal for driving a piezoelectric element of the second nozzle group 41B. Each of the driving signal generation units generates a driving signal for an odd-numbered dot when forming a dot in an odd-numbered dot (which will be described later), and generates a driving signal for an even-numbered dot when forming a dot in an even-numbered dot (which will be described later). Each of the driving signal generation units is independent from each other, and for example, when the first driving signal generation unit 65A is generating a driving signal for an odd-numbered dot, the second driving signal generation unit 65B can generate a driving signal for an odd-numbered dot, and can generate a driving signal for an even-numbered dot.

The controller 60 alternately repeats a "liquid droplet ejecting operation (ejecting process)" in which ink as liquid droplets is ejected from the head 41 in the middle of moving in the scanning direction, and a "transport operation (transport process)" in which the sheet 10 is moved in the transport direction, and prints an image which is formed of a plurality of dots on the sheet 10. In addition, the liquid droplet ejecting operation is referred to as a "pass", and a pass of nth times is referred to as a "pass n".

Configuration of Head

Figure 3:
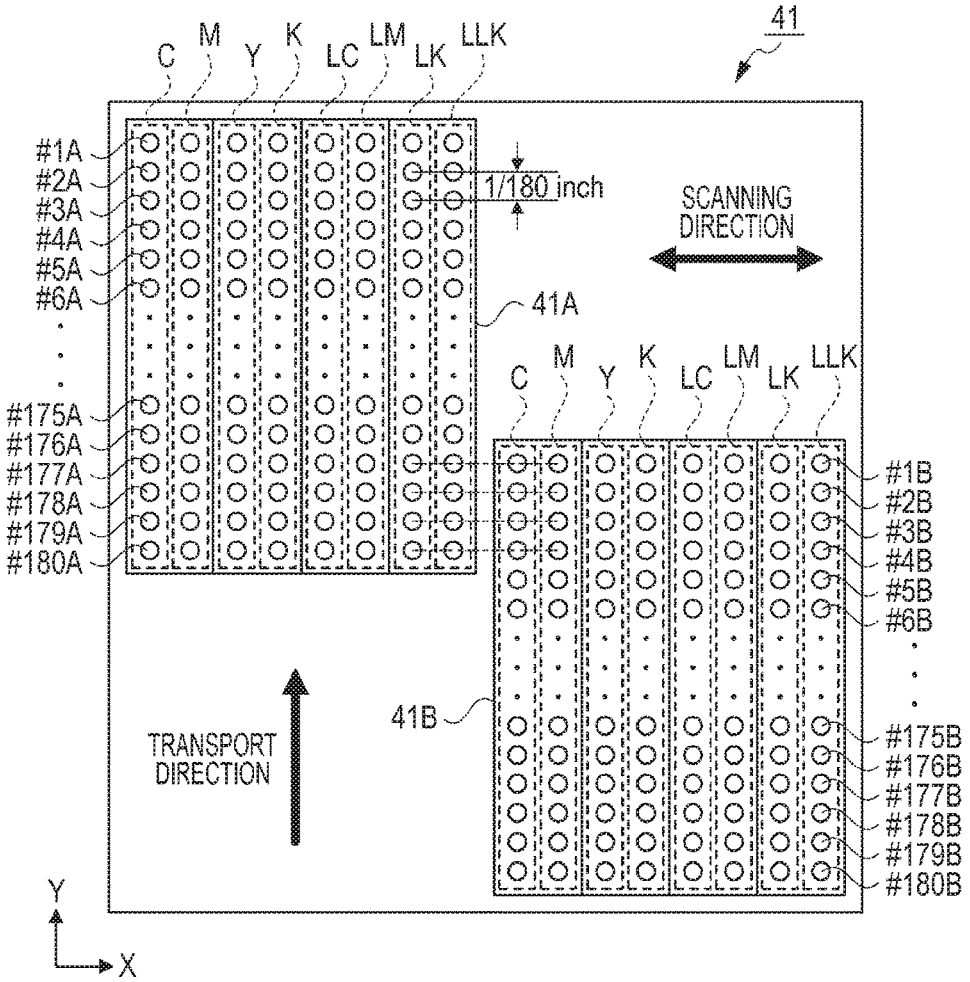
FIG. 3 is an explanatory diagram which illustrates an example of an arrangement of nozzles.

FIG. 3 is an explanatory diagram which illustrates an example of an arrangement of nozzle which are included in the head 41. The head 41 includes the first nozzle group 41A and the second nozzle group 41B as two heads (nozzle groups). Eight nozzle columns are provided in each nozzle group, and ejecting ports of these nozzles are open to a lower face of the head 41. The eight nozzle columns respectively eject ink of cyan (C), magenta (M), yellow (Y), black (K), light cyan (LC), light magenta (LM), light black (LK), and extremely light black (LLK).

In each nozzle column, 180 nozzles (nozzle 1A to 180A and nozzle 1B to 180B) which align in the transport direction are provided at a nozzle pitch of 180 dpi. In FIG. 3, nozzles on the downstream side in the transport direction (+Y side) are attached with lower numbers. A piezoelectric element (not illustrated) as a driving element for causing ink droplets to be ejected from each nozzle is provided in each nozzle.

The first nozzle group 41A is provided on the downstream side of the second nozzle group 41B in the transport direction. In addition, the first nozzle group 41A and the second nozzle group 41B are provided so that positions of four nozzles in the transport direction overlap. For example, a position of the nozzle 177A of the first nozzle group 41A in the transport direction is the same as a position of the nozzle 1B in the second nozzle group 41B. Due to this, in a certain liquid droplet ejecting operation, when the nozzle 177A of the first nozzle group 41A can form a dot with respect to a certain raster, the nozzle 1B of the second nozzle group 41B can also form a dot with respect to the raster.

In addition, a combination of nozzle columns which eject the same ink (ink configured using the same composition) between the first nozzle group 41A and the second nozzle group 41B is referred to as a "head set".

Figure 4:
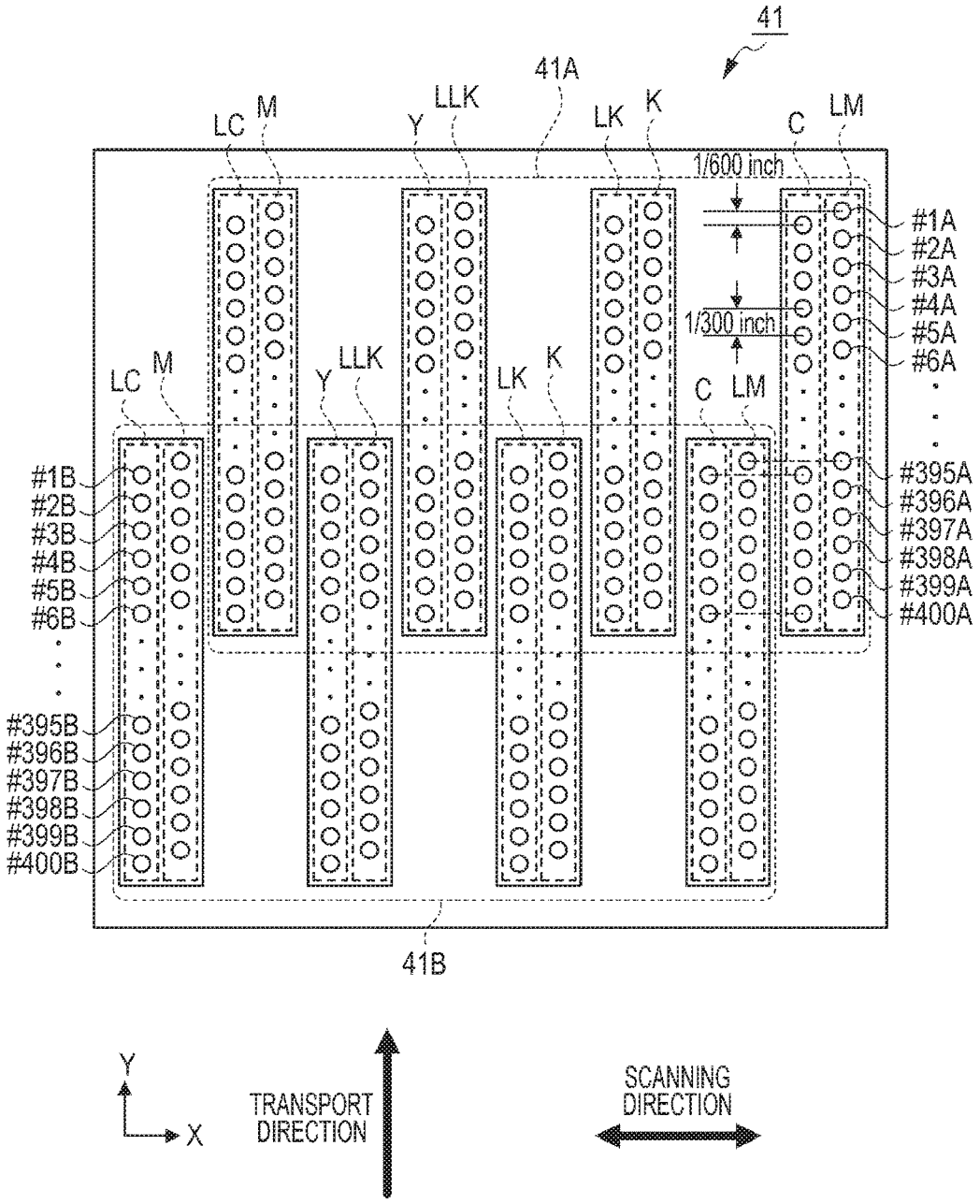
FIG. 4 is an explanatory diagram which illustrates an example of an arrangement of nozzles.

FIG. 4 is an explanatory diagram which illustrates another example of an arrangement of nozzles included in the head 41. In the example illustrated in FIG. 4, the head sets illustrated in FIG. 3 are arranged at positions which are closer. Specifically, in the example in FIG. 4, the first nozzle group 41A and the second nozzle group 41B are arranged so as to alternately align in each nozzle column of one set of two. In addition, 400 nozzles which align in the transport direction (nozzles 1A to 400A and nozzles 1B to 400B) are provided at a nozzle pitch of 300 dpi in each nozzle column, and a nozzle column of one set of two is arranged by being shifted by ½ pitch (1/600 inches).

In addition, the first nozzle group 41A and the second nozzle group 41B are provided so that positions of six nozzles in the transport direction overlap. For example, a position of the nozzle 395A in the transport direction of the first nozzle group 41A is the same as a position of the nozzle 1B in the transport direction of the second nozzle group 41B. Due to this, in a certain liquid droplet ejecting operation, when the nozzle 395A of the first nozzle group 41A can form a dot with respect to a certain raster, the nozzle 1B of the second nozzle group 41B can also form a dot with respect to the raster.

Denoting Method of Nozzle Column and Nozzle

Denoting method of a nozzle column and a nozzle will be described before describing a dot forming method.

Figure 5:
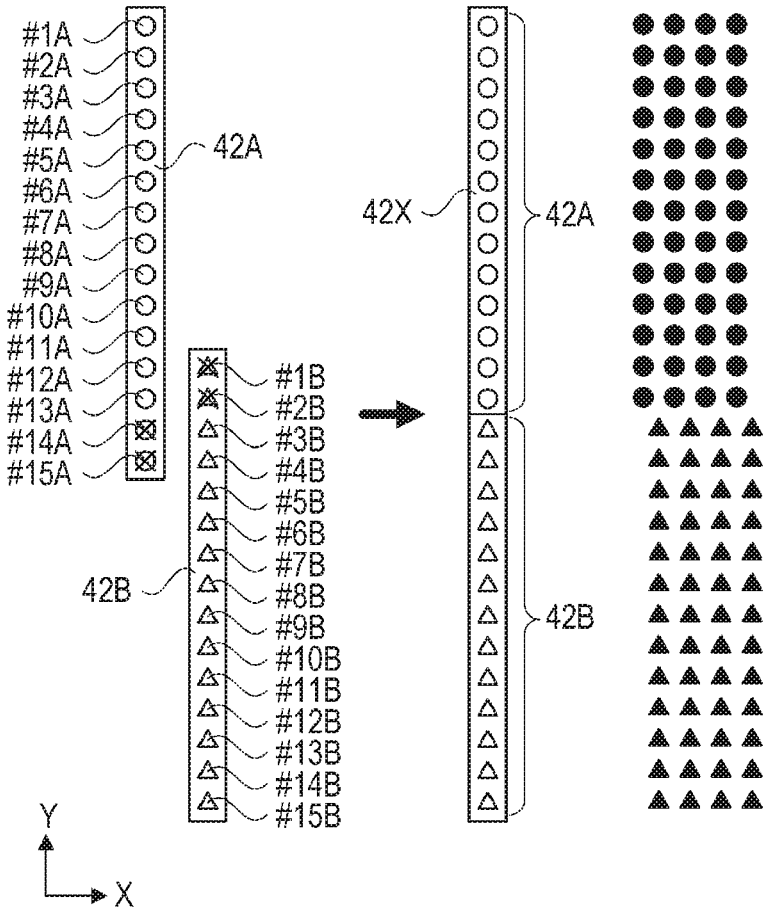
FIG. 5 is an explanatory diagram which denotes a head set as a virtual head set.

FIG. 5 is an explanatory diagram in which a head set is denoted by a virtual head set 42X.

On the left side in FIG. 5, for example, a black nozzle column of the first nozzle group 41A, and a black nozzle column of the second nozzle group 41B are described. In descriptions below, the black nozzle column of the first nozzle group 41A is referred to as a first head 42A, and the black nozzle column of the second nozzle group 41B is referred to as a second head 42B. In addition, for simple descriptions, the number of nozzles of each nozzle column is set to 15. In addition, the first head 42A and the second head 42B correspond to "nozzle columns" in the invention. Specifically, the first head 42A corresponds to a "first nozzle column" in the invention, and the second head 42B corresponds to a "second nozzle column" in the invention.

In four nozzles on the upstream side in the transport direction of the first head 42A (nozzle 12A to nozzle 15A), and in four nozzles on the downstream side of the second head 42B in the transport direction (nozzle 1B to nozzle 4B) overlap, positions thereof in the transport direction overlap. In descriptions below, these four nozzles in each nozzle column are referred to as overlapped nozzles.

Each nozzle of the first head 42A is denoted using a circle, and each nozzle of the second head 42B is denoted using a triangle. In addition, a nozzle which does not eject ink (that is, nozzle which does not form dot) is attached with an x mark.

Here, among overlapped nozzles of the first head 42A, nozzles 12A and 13A eject ink, and nozzles 14A and 15A do not eject ink. In addition, among overlapped nozzles of the second head 42B, nozzles 1B and 2B do not eject ink, and nozzles 3B and 4B eject ink.

In such a case, as described at a center portion in FIG. 5, it is possible to denote two heads (first head 42A and second head 42B) which configure a head set as one virtual head set 42X. In descriptions below, a dot forming mode will be described using the one virtual head set 42X, instead of separately drawing the two heads.

In addition, as illustrated on the right side in FIG. 5, in the virtual head set 42X, even when a circle nozzle forms a dot in an odd-numbered dot (which will be described later), a triangle nozzle can form a dot in an even-numbered dot (which will be described later). As a matter of course, when a circle nozzle forms a dot in an odd-numbered dot, a triangle nozzle can also form a dot in the odd-numbered dot.

In addition, operations of forming a dot by ejecting ink from an individual nozzle are performed based on printing data which is received by the controller 60; however, here, in order to simplify descriptions, ejecting or non-ejecting based on individual printing data is omitted from the descriptions. That is, a state in which a dot is formed with respect to dots in all positions in which a dot can be formed when a corresponding nozzle ejects ink droplets based on printing data will be described as a base.

Dot Forming Method in Normal Processing

Figure 6:
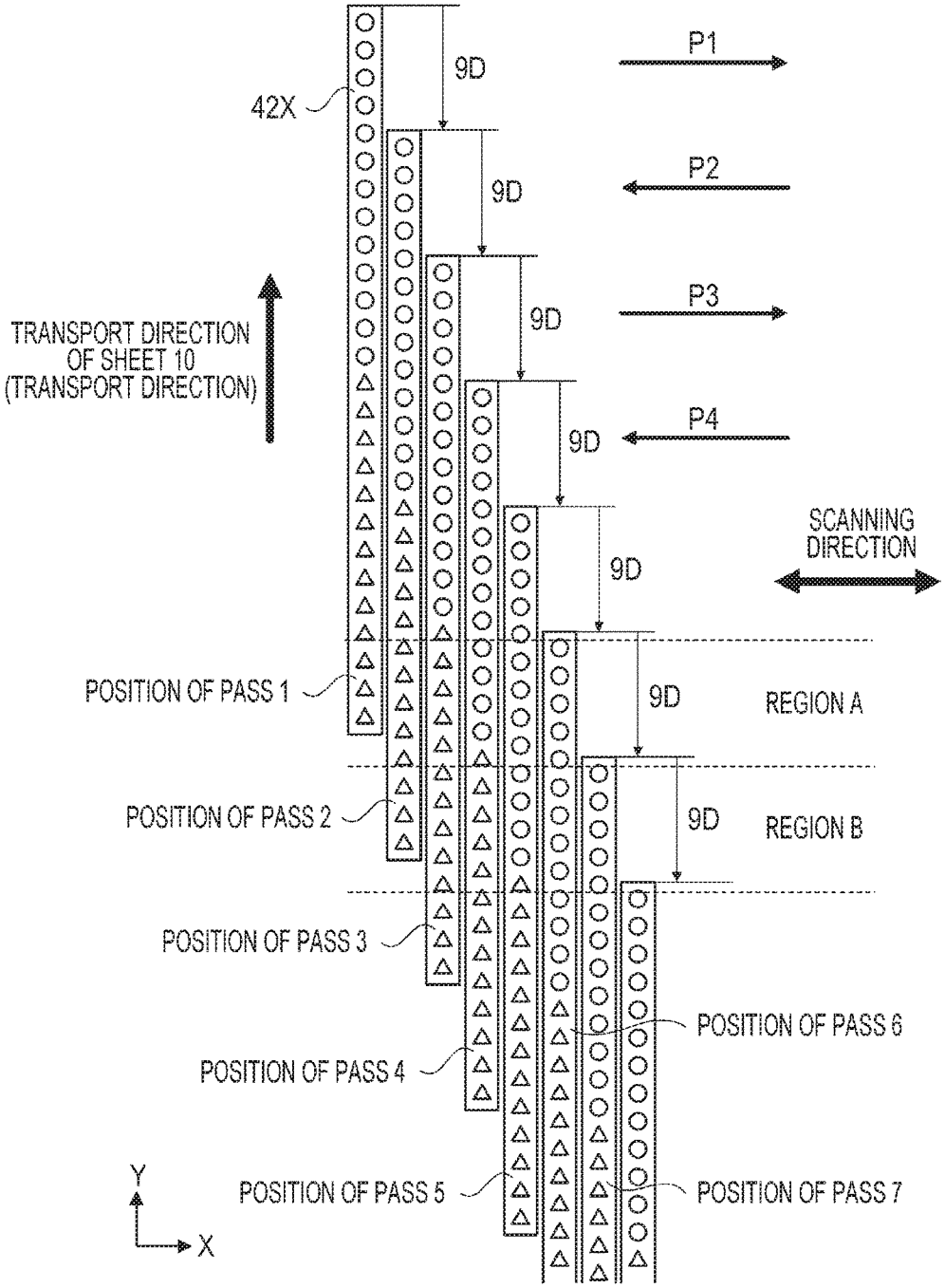
FIG. 6 is an explanatory diagram of an example in normal processing.

FIG. 6 is an explanatory diagram of an example in normal processing. The normal processing is processing which is performed when printing a center portion of the sheet 10

(region neither upper end portion nor lower end portion of sheet 10) (liquid droplet ejecting operation (ejecting operation (ejecting process)) and transport operation (transport process)). The controller 60 performs the normal processing which will be described below by controlling each unit.

In FIG. 6, a relative position of the sheet 10 using the transport unit 20 due to a step movement in each transport amount 9D is illustrated in an oblique direction so that the virtual head set 42X does not overlap. That is, in FIG. 6, it is illustrated as if the virtual head set 42X moves with respect to the sheet 10; however, the sheet 10 moves in the transport direction in practice. In addition, in FIG. 6, a positional relationship of the virtual head set 42X in the +X direction does not make sense. In addition, arrows P1 to P4 denote a direction in which the virtual head set 42X is scanned in the scanning direction (X axis direction).

In the normal processing, in a transport operation which is performed between pass and pas, the sheet 10 is transported by the transport amount 9D of 9 dots. For example, in the region A in FIG. 6 (region on sheet 10), dots are formed using pass 1 to pass 6, and in the region B, dots are formed using pass 2 to pass 7.

In odd-number pass, each nozzle is located at a position of an odd-number raster line (column of dot in scanning direction). Since an operation of even-number pass is performed after the sheet 10 is transported by the transport amount 9D of 9 dots, after the odd-number pass, in the even-number pass each nozzle is located at an even-number raster line. In this manner, a position of each nozzle becomes a position of an odd-number raster line, or a position of an even-number raster line, alternately, in each pass.

Figure 7:
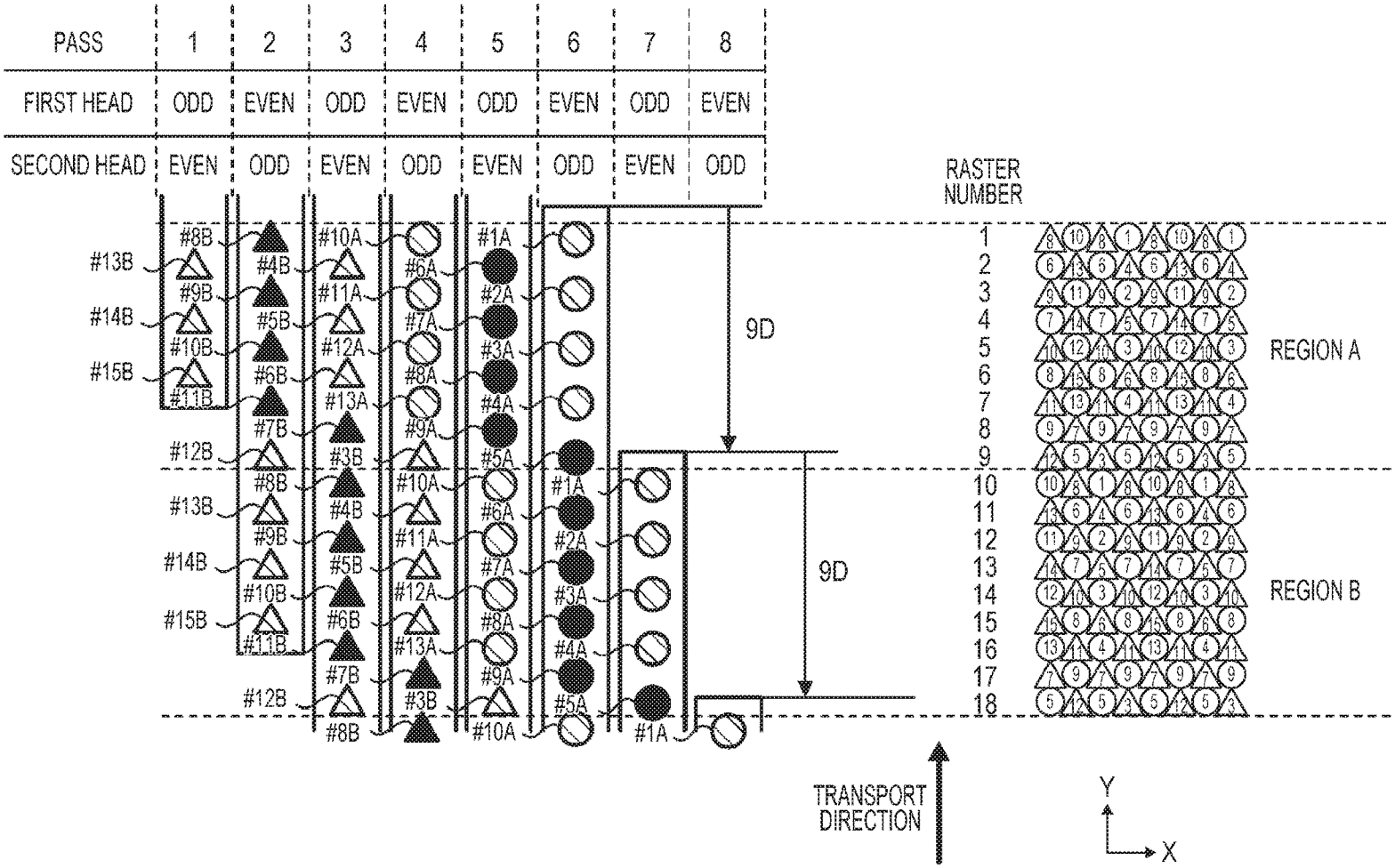
FIG. 7 is an explanatory diagram of a dot forming example in the normal processing.

FIG. 7 is an explanatory diagram of an example of dot forming in the regions A and B in FIG. 6.

Here, in FIG. 7, for example, a case in which one raster is completed using pass of four times is illustrated. In addition, for example, it is possible to form one pixel using four dots (pass of four times) which are vertically and horizontally adjacent to each other.

A relative position of nozzles in each pass is illustrated on the left side in FIG. 7. A black nozzle forms one dot per one pixel in the pass. For example, the nozzle 8B in pass 2 forms one dot with respect to two dot positions. A nozzle which is hatched using oblique lines forms one dot per two pixels. For example, the nozzle 10A in pass 4 forms one dot with respect to four dot positions.

A nozzle which is hatched using oblique lines only forms a half dots compared to a black nozzle. The nozzle which is hatched using oblique lines will be referred to as a partially overlapped nozzle hereinafter. In four nozzles (nozzles 10A to 13A) on the upstream side in the transport direction (−Y side) of the first head 42A of a certain pass, and in four nozzles (nozzles 1A to 4A) on the downstream side in the transport direction (+Y side) of the first head 42A after performing transport operations of two times from the pass, positions thereof in the transport direction overlap. Such nozzles become partially overlapped nozzles. For example, nozzles 10A to 13A of pass 4 and nozzles 1A to 4A of pass 6 become partially overlapped nozzles since positions thereof in the transport direction overlap.

Similarly, in four nozzles (nozzles 12B to 15B) on the upstream side in the transport direction of the second head 42B of a certain pass, and in four nozzles (nozzles 3B to 6B) on the downstream side in the transport direction of the second head 42B after performing transport operations of two times from the pass, positions thereof in the transport direction overlap. Such nozzles become partially overlapped nozzles. For example, nozzles 12B to 15B of pass 2, and nozzles 3B to 6B of pass 4 become partially overlapped nozzles since positions thereof in the transport direction overlap. In addition, as a result of performing printing using partially overlapped nozzles, when a control of printing is performed so that a region in which printing is performed in a certain pass is overlapped with another pass in a part of region, the control is referred to as a partial overlapping control.

On the left side in FIG. 7, nozzles which form a dot in each pixel are illustrated. For example, the first raster line (line of which raster number is 1) is configured of dots which are formed as odd-numbered dots using a nozzle 8B, and dots which are formed as even-numbered dots using nozzles 10A and 1A. In addition, here, in order to simplify descriptions, each raster line is configured using only 8 dots.

Positions of dots which are formed using each head are illustrated on the upper left side in FIG. 7. For example, in pass 1, nozzles of the first head 42A (nozzles 1A to 13A) form dots in odd-numbered dots, and nozzles of the second head 42B (nozzles 3B to 15B) form dots in the even-numbered dots.

Each raster line is configured of dots which are formed using two or three nozzles. In other words, two or three nozzles correspond to each raster line. For example, a nozzle 8B in pass 2, a nozzle 10A in pass 4, and a nozzle 1A of pass 6 correspond to the first raster line. In addition, each raster line is configured of dots which are formed using at least one nozzle of the first head 42A, and dots which are formed using at least one nozzle of the second head 42B. In other words, at least one nozzle of the first head 42A and at least one nozzle of the second head 42B correspond to each raster line.

When only one nozzle corresponds to an odd-numbered dot and an even-numbered dot in a certain raster line, the nozzle forms one dot with respect to two dots. For example, only one nozzle 8B corresponds to an odd-numbered dot in the first raster line (another nozzle does not correspond). For this reason, the nozzle 8B forms one dot with respect to two dots.

Meanwhile, when two nozzles correspond to an odd-numbered dot or an even-numbered dot of a certain raster line, the two nozzles respectively form one dot with respect to four dots (it becomes partially overlapped nozzle). For example, nozzles 10A and 1A correspond to even-numbered dots in the first raster line. For this reason, the nozzles 10A and 1A respectively form one dot with respect to four dots (it becomes partially overlapped nozzle).

In the normal processing, positions of forming dots using the first head 42A (position in scanning direction), and positions of forming dots using the second head 42B are different in a certain pass. Specifically, when the first head 42A form dots in odd-numbered dots, the second head 42B form dots in even-numbered dots. In contrast to this, when the first head 42A forms dots in even-numbered dots, the second head 42B forms dots in odd-numbered dots. Such dot forming is possible, since the above described first driving signal generation unit 65A and second driving signal generation unit 65B can generate a driving signal by being independent from each other.

In addition, in the normal processing, when comparing a certain pass to the subsequent pass, positions at which each head forms dots are different. For example, when the first head 42A forms dots in odd-numbered dots, and the second head 42B forms dots in even-numbered dots in a certain pass, the first head 42A forms dots in even-numbered dots, and the second head 42B forms dots in odd-numbered dots in the subsequent pass.

By forming dots in this manner, dots are formed in a hound's tooth check shape using one head, and dots are formed in the hound's tooth check shape using the other head so that a space between dots which are formed in the hound's tooth check shape is filled with the dots. When focusing on the right side in FIG. 7, circle dots which are formed using the first head 42A are formed in the hound's tooth check shape, and triangle dots which are formed using the second head 42B are also formed in the hound's tooth check shape. In addition, as dot forming order, dots are formed in the hound's tooth check shape using the second head 42B, and then dots are formed using the first head 42A so as to fill a space therebetween with the dots.

When a raster line is formed in the normal processing, in the raster line, a half of dots are formed using the first head 42A, and dots of a remaining half are formed using the second head 42B. In other words, a use rate of each head when forming these raster lines is 50% in the first head 42A (constant), and is also 50% in the second head 42B (constant).

Since dots are formed using pass 1 to pass 6 in the region A, and dots are formed using pass 2 to pass 7 in the region B, one pass is shifted between the region A and the region B. Since pass of one time is shifted, positions of dots which are formed in each nozzle (position in scanning direction) are different either in odd-numbered dots or in even-numbered dots. For example, the nozzle 8B in pass 2 forms dots in odd-numbered dots with respect to the first raster line; however, the nozzle 8B in pass 3 forms dots in even-numbered dots with respect to the tenth raster line.

In addition, though they are not illustrated here, in the 19th raster line to the 27th raster line on the upstream side of the region B in the transport direction, approximately the same dots as those in the region A are formed using pass 3 to pass 8. For example, to the 19th raster line, nozzles 8B, 10A, and 1A correspond, and the nozzle 8B forms dots in odd-numbered dots of the 19th raster line. In addition, in the 28th raster line to the 36th raster line which are located on the upstream side of the 19th raster line to the 27th raster line in the transport direction, dots are formed using pass 4 to pass 9. In this manner, when the normal processing is continuously performed, the same dot forming operations as those in the region A and the region B are repeatedly performed.

When a high definition image is formed on the sheet 10, for example, by forming dots on the sheet 10, it is necessary to reliably hold the sheet 10 at a predetermined position (and height) during the liquid droplet ejecting operation, and accurately moves the sheet 10 at a predetermined position in the transport operation. For this reason, the transport unit 20 fixes (holds) the sheet 10 using, for example, units which interposes, presses, or suctions the sheet. It is necessary for these fixing (holding) units to have a configuration of not interfering with a motion of the carriage unit 30, the head unit 40, or the like. In other words, it is a configuration in which printing is started in a state (position) in which the sheet 10 is reliably fixed (held) at the upper end portion or the lower end portion, and is finished. As a result, for example, as in the embodiment, in the configuration in which the first nozzle group 41A and the second nozzle group 41B which include nozzle columns which align in the transport direction (+Y direction) are aligned in the transport direction (+Y direction), there is a case in which dots have to be formed using only corresponding nozzles of corresponding heads (first head 42A or second head 42B) with respect to the respective upper end portion and lower end portion of the sheet 10.

Dot Forming Method Using Upper End Processing

Hereinafter, an example of upper end processing when it is not possible to form an image which is subjected to a partial overlapping control between a plurality of heads will be described. The upper end processing is processing which is performed when printing an upper end region (end region on +Y side) of the sheet 10 (liquid droplet ejecting operation (ejecting operation) and transport operation). The controller 60 performs upper end processing which will be described below, by controlling each unit.

Figure 8A:
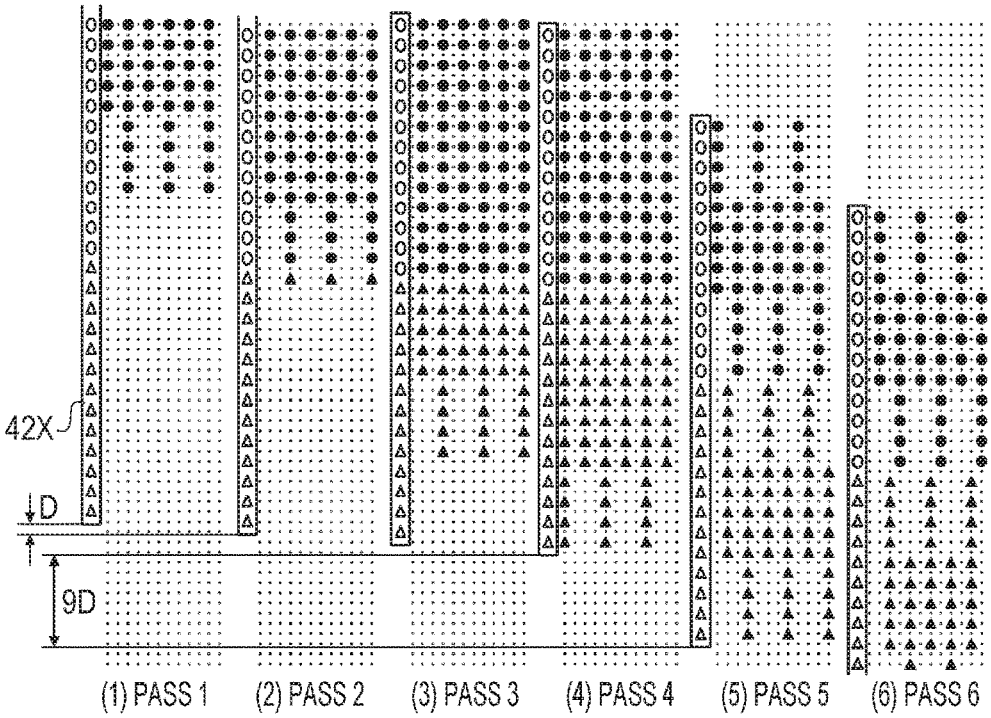
FIG. 8A is an explanatory diagram of an example in upper end processing according to the related art.
Figure 8B:
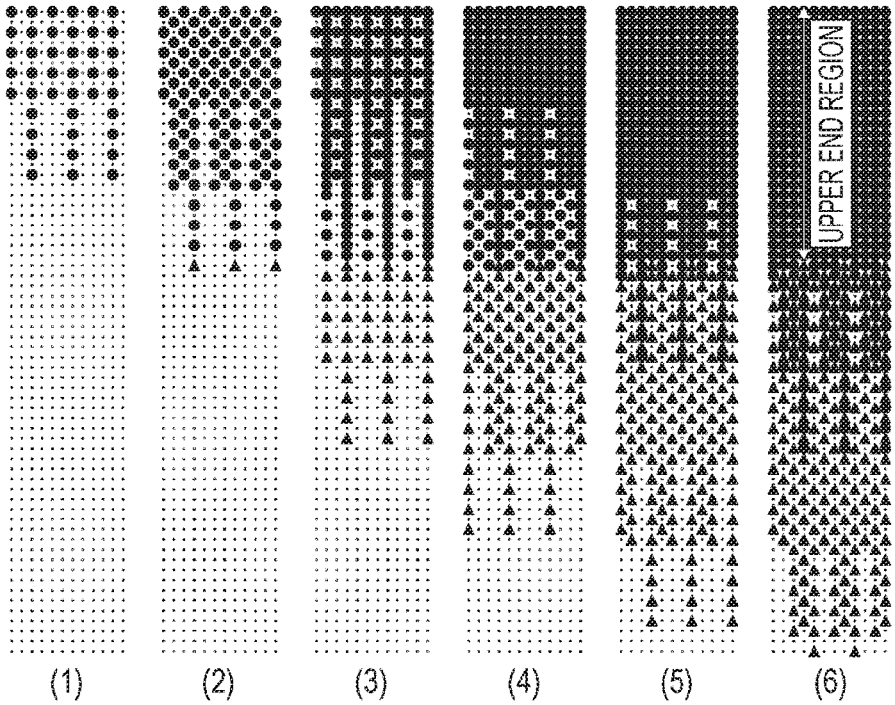
FIG. 8B is an explanatory diagram of an example in upper end processing according to the related art.

FIGS. 8A and 8B are explanatory diagrams of an example of upper end processing, and FIGS. 8A(1) to 8A(4) illustrate the virtual head set 42X and positions of ink droplets which are ejected in each pass (pass 1 to pass 4) in the upper end processing, and FIGS. 8A(5) and 8A(6) illustrate the virtual head set 42X and positions of ink droplets which are ejected in each pass (pass 5 and pass 6) in the normal processing following the upper end processing.

FIGS. 8B(1) to 8B(6) illustrate dots which are formed on the sheet 10 using pass 1 to pass 6. That is, a result which is obtained by overlapping positions of ink droplets in FIGS. 8A(1) to 8A(6) is turned out as FIGS. 8B(1) to 8B(6).

In the example illustrated here, the upper end processing is performed in pass 1 to pass 4, and the normal processing is performed after pass 5. In the upper end processing, in a transport operation which is performed between pass and pass, the sheet 10 is transported by a transport amount D (transport amount which is smaller than transport amount 9D) of one dot.

In the upper end processing, in even-numbered pass, each nozzle is located at a position of an odd-numbered raster line. Since the sheet 10 is transported by a transport amount of one dot after the even-numbered pass, each nozzle is located at a position of an even-numbered raster line in the even-numbered pass. In this manner, also in the upper end processing, a position of each nozzle becomes a position of an odd-numbered raster line or an even-numbered raster line, alternately, in each pass.

In the above described upper end processing, in order to form dots in a hound's tooth check shape, respectively, using each head, dot forming positions of the first head 42A, and dot forming positions of the second head 42B in a certain pass are set to be different. For example, when the first head 42A forms dots in odd-numbered dots, the second head 42B forms dot in even-numbered dots.

In contrast to this, in the upper end processing, dot forming positions of the first head 42A, and dot forming positions of the second head 42B in a certain pass are the same. For example, in pass 1, both the first head 42A and the second head 42B form dots in odd-numbered dots.

In addition, in the normal processing, in order to form dots in hound's tooth check shape, respectively, using each head, dot forming positions of each head are set to be different between a certain pass and the subsequent pass. For example, when the first head 42A forms dots in odd-numbered dots, and the second head 42B forms dots in even-numbered dots in a certain pass, the first head 42A forms dots in even-numbered dots, and the second head 42B forms dots in odd-numbered dots in the subsequent pass.

In contrast to this, in the upper end processing, a dot forming position of each head is changed in order of an odd-numbered dot (pass 1)→an even-numbered dot (pass 2)→an even-numbered dot (pass 3)→an odd-numbered dot (pass 4). That is, in the upper end processing, there is a case in which a dot forming position of each head is not necessarily different between a certain pass and the subsequent pass. For example, in pass 2 and pass 3, dot forming positions are the same even-numbered dots.

The reason why there is the difference between the normal processing and the upper end processing is that, in the normal processing, dots are formed in a hound's tooth check shape, respectively, using each head; however, in the upper end processing, dots are formed in the hound's tooth check shape in two passes in the first half among four passes, and dots are formed in the hound's tooth check shape in two passes in the second half among so that a space between dots in the hound's tooth check shape is filled with the dots.

The first to 25th raster lines (raster lines on upper end side of sheet 10) are formed using only the first head 42A, using the above described dot forming method. In other words, a head use rate when forming the first to 25th raster lines is 100% in the first head 42A, and 0% in the second head 42B.

Figure 9:
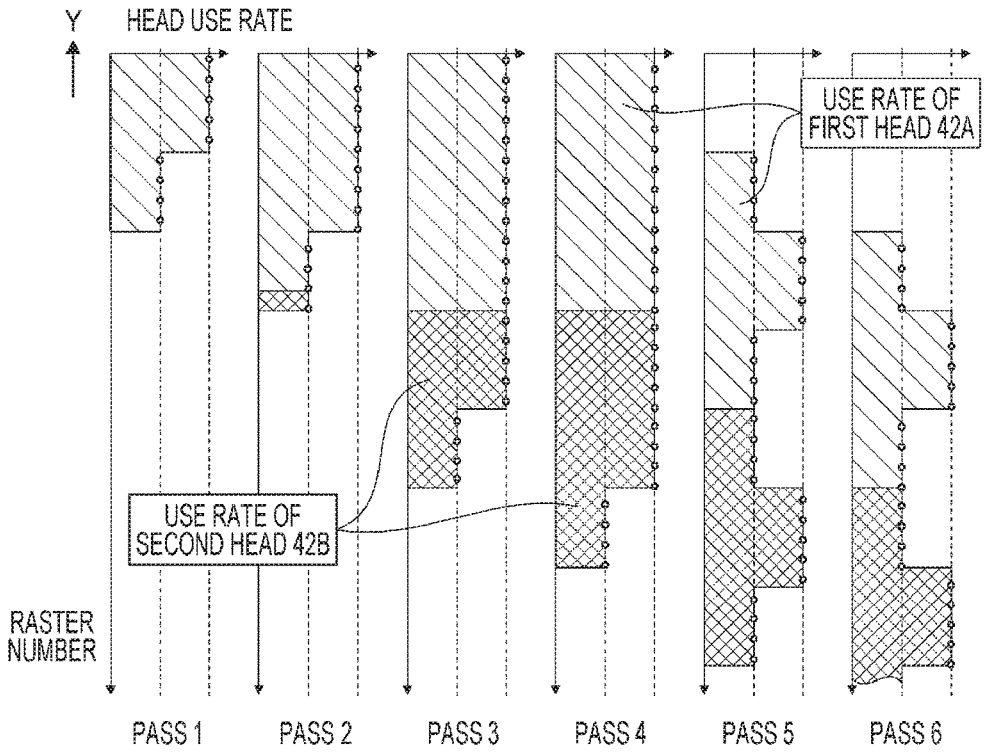
FIG. 9 is a graph which schematically illustrates a use rate of a head in each of passes 1 to 6.

FIG. 9 is a graph which schematically illustrates use rates of the first head 42A and the second head 42B in each pass (pass 1 to pass 6).

Hitherto, for ease of descriptions, dots have been described by being illustrated in a visible range. For this reason, as illustrated in FIG. 9, a change in use rate of each head (difference in direction of raster number) is illustrated in stages; however, in a practical use, since an image is formed using countless dots which are formed using ink droplets of a few picoliters, in a use rate of each head, a change thereof can be denoted using linear approximation, or curve approximation, as illustrated in the following figure.

Figure 10A:
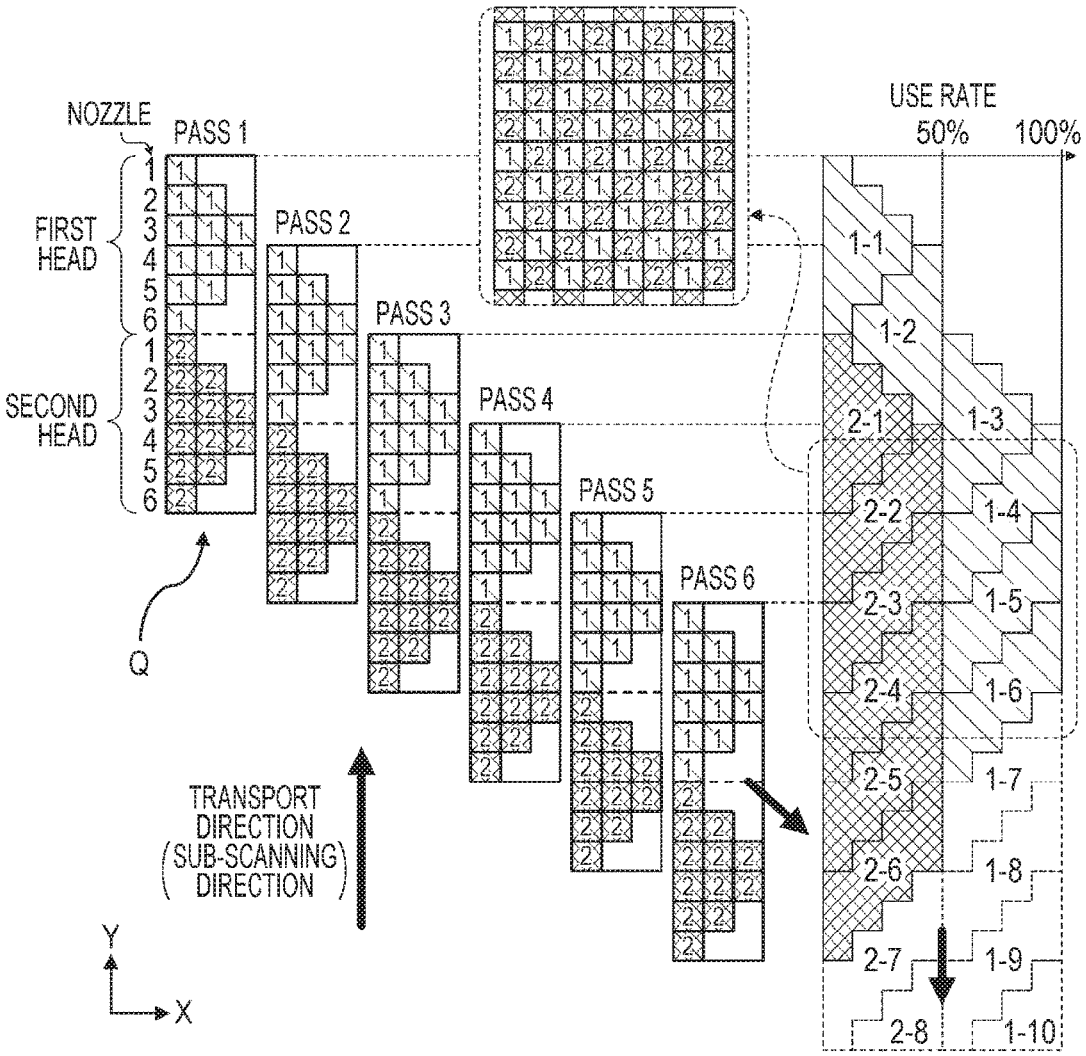
FIG. 10A is an explanatory diagram when denoting a use rate of a head using linear approximation.
Figure 10B:
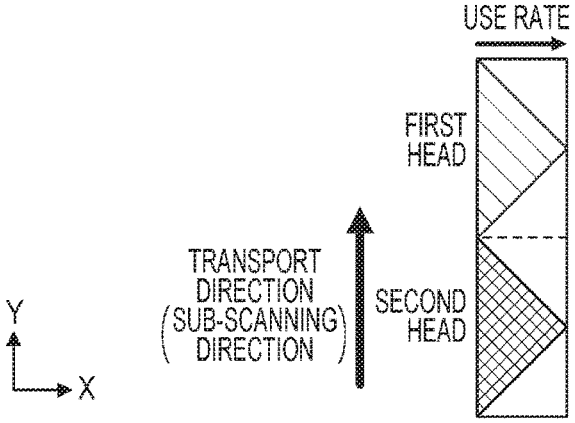
FIG. 10B is an explanatory diagram when denoting a use rate of a head using linear approximation, and which denotes the XB portion in FIG. 10A in another expression.

FIGS. 10A and 10B are explanatory diagrams when denoting a head use rate using linear approximation.

For example, FIG. 10A illustrates the normal processing in which three dots are formed per nozzle at maximum in one pass using two heads including six nozzles. In the normal processing, as illustrated on the right side in FIG. 10A, four dots which are formed using the respective heads, that is, a solid pattern in which a use rate of each head is 50% (dots are arranged in hound's tooth check shape as illustrated on upper part in FIG. 10A) is formed.

When an image is formed using countless dots which are formed using ink droplets of a few picoliters, blocks which are piled up in a pyramid shape which is drawn in each pass in FIG. 10A can be expressed using a triangle (or trapezoidal shape) which is illustrated in FIG. 10B, by replacing the number of dots to a use rate of each nozzle.

Hereinafter, a distribution of a nozzle use rate (that is, use rate of each head in each raster line) in each pass will be described using the expression in which the triangle (or trapezoidal shape) is used.

Figure 11:
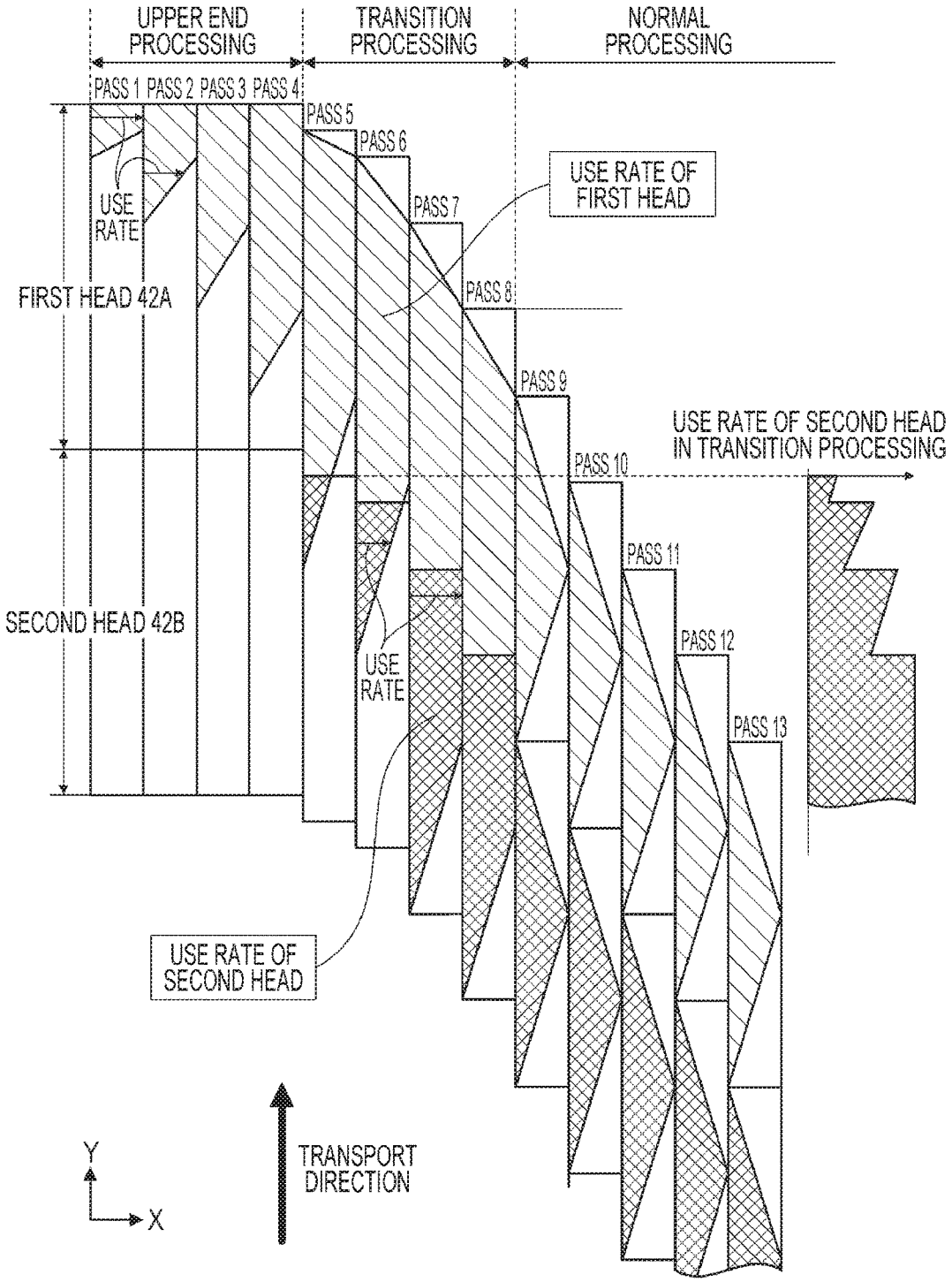
FIG. 11 is a graph which denotes a transition of a use rate of a head in upper end processing using the related art.

FIG. 11 is a graph which illustrates a transition of a head use rate of the respective first head 42A and the second head 42B in a region of the normal processing from the upper end processing.

In FIG. 11, the head set using the first head 42A and the second head 42B is illustrated as the first head 42A and the second head 42B of one column which aligns in the +Y direction like the virtual head set 42X which is illustrated in FIG. 5. In addition, a relative position due to a movement of the sheet 10 using the transport unit 20 is illustrated by arranging the first head 42A and the second head 42B so as not to overlap, similarly to that in FIG. 6. That is, in FIG. 11, it is illustrated as if the first head 42A and the second head 42B move with respect to the sheet 10; however, in practice, the sheet 10 moves in the transport direction (+Y direction). In addition, in FIG. 11, a positional relationship between the first head 42A and the second head 42B in the +X direction does not make sense. In addition, use rates of respective heads (use rate in each nozzle which belongs to respective heads in each raster line) are illustrated similarly to those in FIG. 9.

Pass 1 to pass 4 are for upper end processing in which an image is formed using only the first head 42A, pass 5 to pass 8 are for transition processing in which a use rate of the second head 42B gradually increases, and pass 9 and thereafter are for the normal processing in which the use rates of the first head 42A and the second head 42B become 50%, respectively. A region which is formed in pass 5 and thereafter becomes an image region in which a partial overlapping control is performed between two heads.

In addition, in the upper end processing based on the above descriptions, transition processing in which the use rate of the second head 42B gradually increases in each pass; however, when viewed in each raster line, as illustrated on the right side in FIG. 11, the use rate of the second head 42B increases in a stepwise manner (saw tooth shape) in the −Y direction. For this reason, when there is a difference in ejecting property between nozzles which configure the first head 42A and the second head 42B, an influence thereof is expressed in the stepwise manner (saw tooth shape). Specifically, for example, when a diameter of a nozzle opening in the second head 42B becomes larger than that of the first head 42A due to a variation in manufacturing, or the like, liquid droplets which are ejected become large, and as a result, a concentration difference corresponding to an increase of a decrease of a use rate of the second head 42B is expressed. Therefore, in the related art, this problem is improved using a method which will be described below.

Upper End Processing in Related Art

Figure 12:
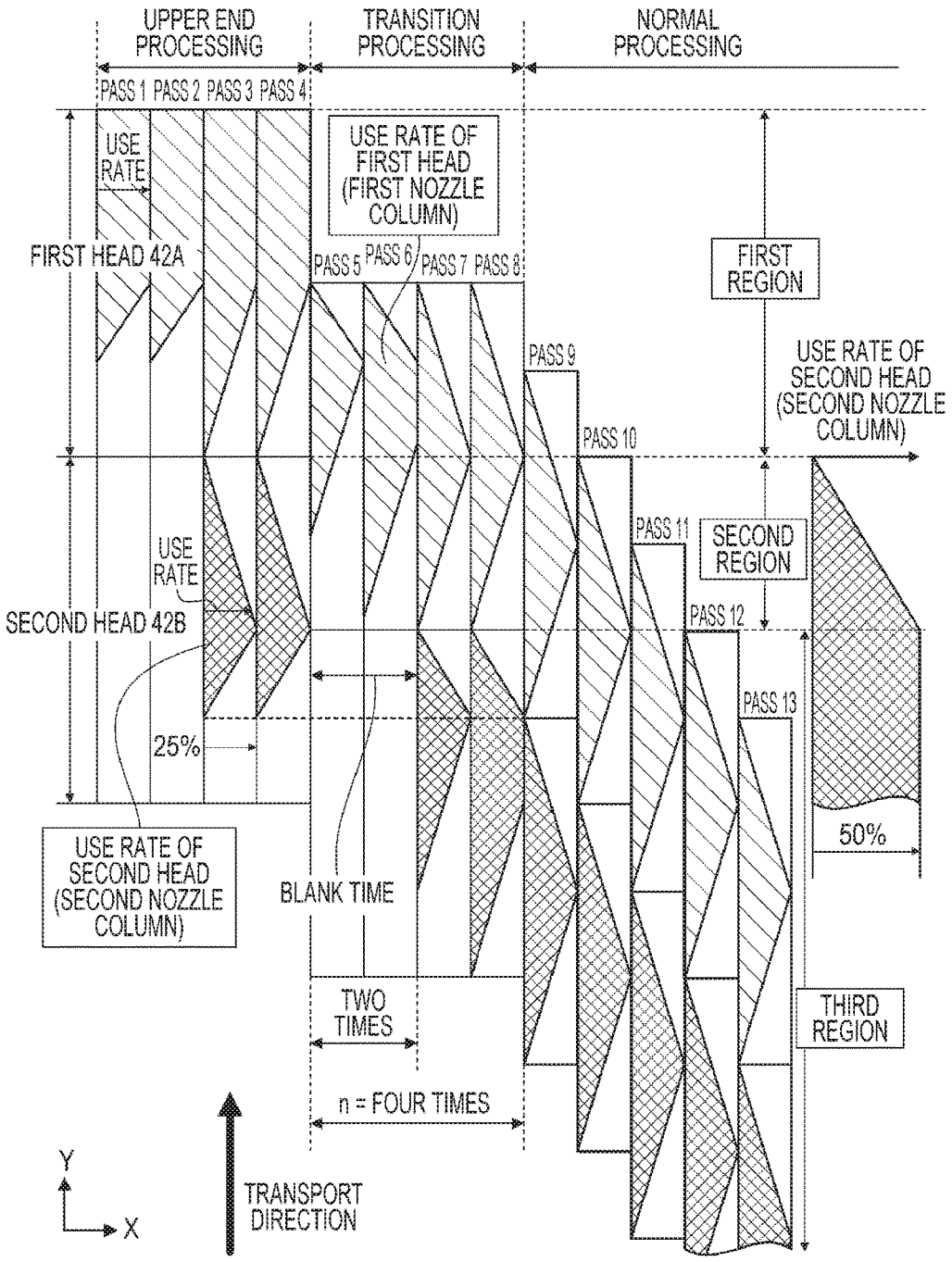
FIG. 12 is a graph which denotes a transition of respective use rates of a first head and a second head in the related art.

FIG. 12 is a graph which illustrates a transition of a use rate of respective head of a first nozzle column (first head 42A) and a second nozzle column (second head 42B) in the printer 100.

Similarly to FIG. 11, FIG. 12 illustrates the head set using the first head 42A and the second head 42B as the first head 42A and the second head 42B of one column which aligns in the +Y direction like the virtual head set 42X which is illustrated in FIG. 5. In addition, similarly to that in FIG. 6, a relative position due to a movement of the sheet 10 using the transport unit 20 is illustrated by arranging the first head 42A and the second head 42B in an oblique direction so as not to overlap. That is, in FIG. 12, it is illustrated as if the first head 42A and the second head 42B move with respect to the sheet 10; however, in practice, the sheet 10 moves in the transport direction (+Y direction). In addition, in FIG. 12, a positional relationship between the first head 42A and the second head 42B in the +X direction does not make sense. In addition, respective head use rates (use rate in each nozzle which belongs to respective heads in each raster line) are illustrated similarly to those in FIG. 9.

The printer 100 performs transition processing to the upper end processing and the normal processing in printing in the upper end region of the sheet 10. As a result, a region on the sheet 10 in which dots are formed is divided into three regions of a first region, a second region which is located in the −Y direction of the first region, and is continuous to the first region, and third region which is located in the −Y direction of the second region, and is continuous to the second region due to a difference in use rate of the respective first head 42A and the second head 42B. In other words, a head use rate is changed by dividing the region into three regions so that, even when there is a difference in property of the head, an influence thereof is rarely visualized.

First, dots are formed using only the first head 42A with respect to the first region.

When dots are formed using the first head 42A and the second head 42B with respect to the second region, and a ratio of the number of dots which are formed using the second head 42B to a total sum of the number of dots which are formed using the first head 42A and the number of dots which are formed using the second head 42B is set to a use rate of the second head 42B, in dot columns which align in the +X direction (raster line), the use rate of the second head 42B is gradually increased in the −Y direction in the plurality of dot columns which align in the +X direction (that is, over the plurality of raster lines).

Dots are formed using the first head 42A and the second head 42B with respect to the third region, and a use rate of the second head is set to be constant (50%).

Hereinafter, it will be described in detail below.

As illustrated in FIG. 12, the upper end processing is performed using pass 1 to pass 4, and the transition processing is performed using pass 5 to pass 8. In the transition processing (pass 5 to pass 8), transporting of a half of length of one head is performed with respect to the upper end processing (pass 1 to pass 4), and a partial overlapping control is performed between the upper end processing (pass 1 to pass 4) and the transition processing (pass 5 to pass 8).

In pass 3 and pass 4 in the upper end processing, in each raster line, when a ratio of the number of dots which is formed by one pass using the second head 42B to a total support member of the number of dots which is formed using the first head 42A and the number of dots which is formed using the second head 42B is set to a use rate of one pass of the second head, respectively, the use rate of one pass of the second head is distributed as follows.

In a plurality of dot columns which are formed by one pass (that is, plurality of raster lines which are formed using one pass) using the plurality of nozzles included in the second head 42B, and which align in the +X direction, it is set so that a use rate of one pass of the second head is increased to 25% from 0%, and is decreased to 0% from 25% in the −Y direction.

Pass 7 and pass 8 are set so that portions in which use rates of the second head 42B are distributed in this manner in pass 3 and pass 4 are subjected to a partial overlapping control between the first head 42A and the second head 42B in pass 7 and pass 8.

Pass 9 and thereafter are passes using the normal processing.

A graph of a use rate of the second head 42B is illustrated on the right side in FIG. 12 as a result which is obtained by overlapping these (pass 1 to pass 9 and thereafter).

The first region which is formed using only the first head 42A, the second region which is formed using the first head 42A and the second head 42B, and in which the use rate of the second head 42B increases to 50% from 0% in the −Y direction in each raster line, and the third region in which the first head 42A and the second head 42B are used by 50%, respectively, are formed.

In this manner, since it is configured so that a use rate of the second head 42B gradually increases from the first region toward the third region in the second region, for example, even in a case in which there is a difference between a property of the first head 42A (property of ejecting liquid droplets) and a property of the second head 42B, a change thereof becomes smooth.

However, as a result of hastening a use of the second head 42B which has been used in pass 5 and pass 6 in the transition processing (refer to FIG. 11) in timings of pass 3 and pass 4 in the upper end processing, a blank time (pass of two times) occurs in ejecting of ink droplets using the second head 42B (refer to FIG. 12) between pass 4 and pass 7. Meanwhile, the second head 42B is continuously used in pass 7 and thereafter.

There is a case in which banding (unevenness) occurs due to an influence of such a blank time; however, in the related art, such a blank time has not been taken into consideration, particularly. As a result, there has been a case in which an influence of a blank time of the second head 42B in the transition processing appears as banding (unevenness). Specifically, among dots which are formed using the second head 42B in pass 3 and pass 4, dots in the same region as dots which are formed in pass 7 and pass 8, thereafter, causes banding in the region by being dried in the blank time of pass 5 and pass 6. That is, there has been a case in which banding occurs when a degree of blurring or a surface shape of ink droplets which are ejected using the second head 42B in pass 7 and pass 8 is different from a degree of blurring or a surface shape of ink droplets which are ejected using the second head 42B in pass 9 and thereafter.

According to the embodiment, the situation is improved using a method which will be described below.

Upper End Processing in Embodiment

In a liquid droplet ejecting method according to the embodiment in which an image configured of a raster which is completed using liquid droplet ejecting operations of n times is formed, in a liquid droplet ejecting operation after a liquid droplet ejecting operation in which the first nozzle column and the second nozzle column are used in one liquid droplet ejecting operation, the number of times in which the liquid droplet ejecting operation of not using the second nozzle column is continuous is less than 0.5n times. In addition, here, "not using" the nozzle column does not includes a case of not using the nozzle column based on image data to be printed. That is, it means that the nozzle column is not used regardless of an image to be printed.

Example 1

Figure 13:
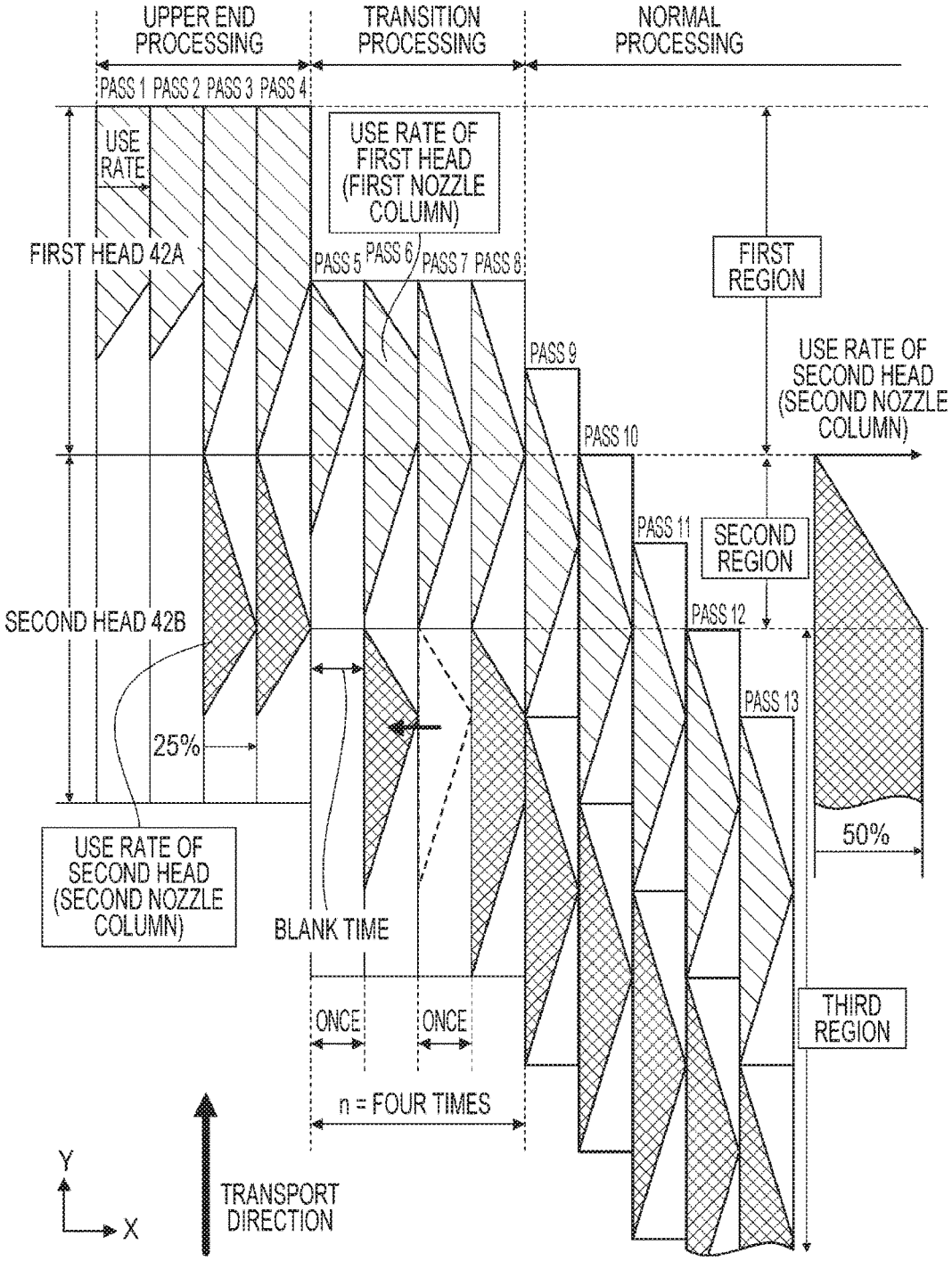
FIG. 13 is a graph which denotes a transition of respective use rates of a first head and a second head in example 1.

FIG. 13 is a graph of example 1 which illustrates a transition of a head use rate of the respective first head 42A and second head 42B which are included in the ink jet printer 100 according to the first embodiment. A liquid droplet ejecting method as an example of an embodiment (example 1) in which the invention is embodied will be described with reference to FIG. 13.

In a liquid droplet ejecting method in the example in which an image configured of a raster which is completed using liquid droplet ejecting operations of n=4 times, in a liquid droplet ejecting operation after a liquid droplet ejecting operation in which the first nozzle column and the second nozzle column are used in one liquid droplet ejecting operation, that is, in a liquid droplet ejecting operation after starting a use of the second nozzle column (second head 42B), the number of times in which the liquid droplet ejecting operation of not using the second nozzle column (second head 42B) is continuous is less than 0.5n=2 times. Specifically, a use of the second nozzle column (second head 42B) in pass 7 illustrated in FIG. 12 is further hastened in use at a timing of pass 6. As a result, a blank time (the number of times m) of ejecting of ink droplets using the second nozzle column (second head 42B) is shortened by one pass (0.5n is less than two times), and a timing of generating the blank time is dispersed to two portions from one portion.

Example 2

Figure 14:
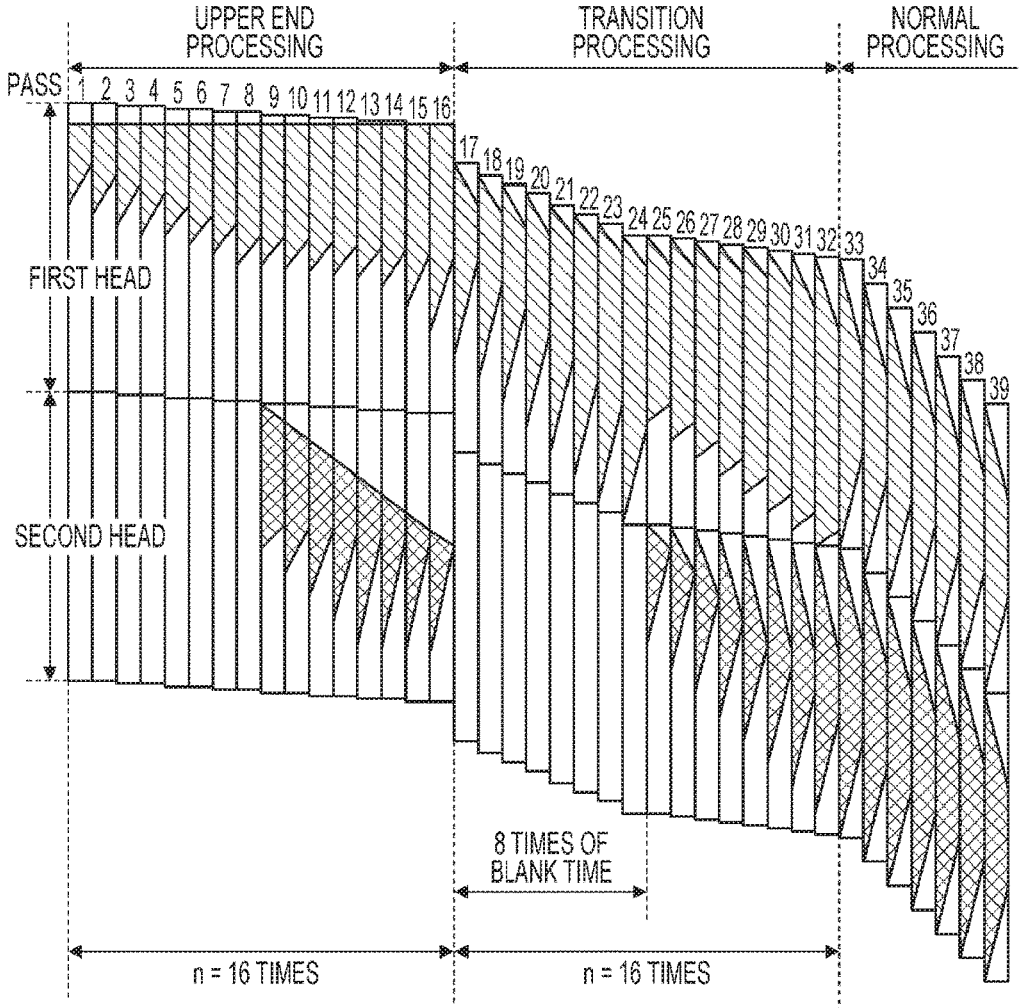
FIG. 14 is a graph which denotes a transition of respective use rates of a first head and a second head in another example in the related art.

FIG. 14 is a graph which illustrates a transition of a use rate of the respective heads in the related art when one raster is formed using pass of n=16 times, using, for example, two nozzle columns (first head and second head) which are configured of 96 nozzles.

According to the method in the related art, banding which is caused when the second head is not used between pass 17 and pass 24 easily occurs.

Figure 15:
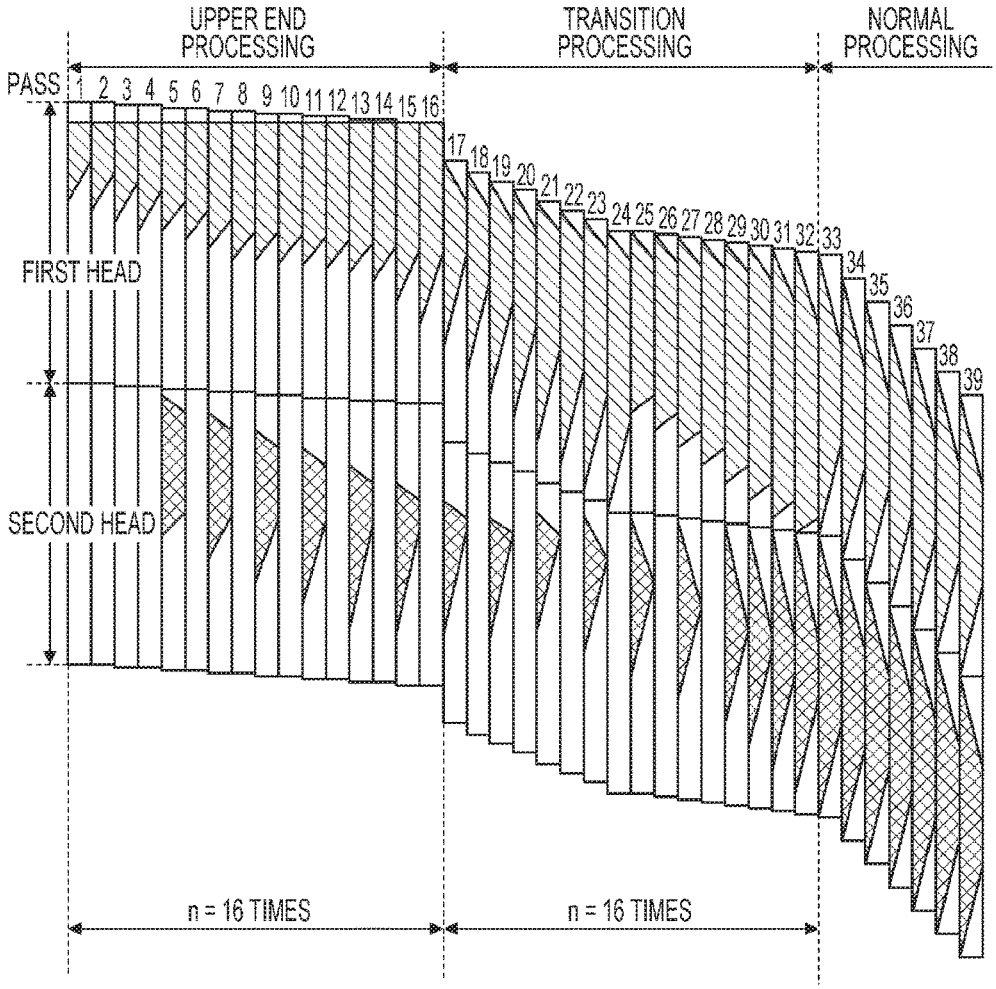
FIG. 15 is a graph which denotes a transition of respective use rates of a first head and a second head in example 2.

In contrast to this, FIG. 15 is a graph which illustrates a transition of a use rate of the respective heads in example 2 according to the first embodiment of the invention.

In example 2, use of the second head 42B in pass 9 to pass 16 in the upper end processing, and in pass 25 to pass 28 in the transition processing in the related art which are illustrated in FIG. 14 are dispersed so that a blank time (the number of times m) of the use becomes one pass.

That is, 8 blank times (the number of times m=8) of pass 17 to pass 24 which are continuous, and illustrated in FIG. 14 are dispersed by being divided into one blank time (the number of times m=1). In addition, continuous use of pass 9 to pass 16 (FIG. 14) prior to the continuous blank times of 8 passes are similarly dispersed, as well, so that one blank time is inserted therebetween. As a result, it is set so that use and disuse are equally repeated between pass at which use of the second nozzle column (second head) is started (pass 5) and pass at which continuous use is started (pass 29). That is, there is no blank time of continuous pass, and no variation in blank time (the number of times m).

Example 3

Figure 16:
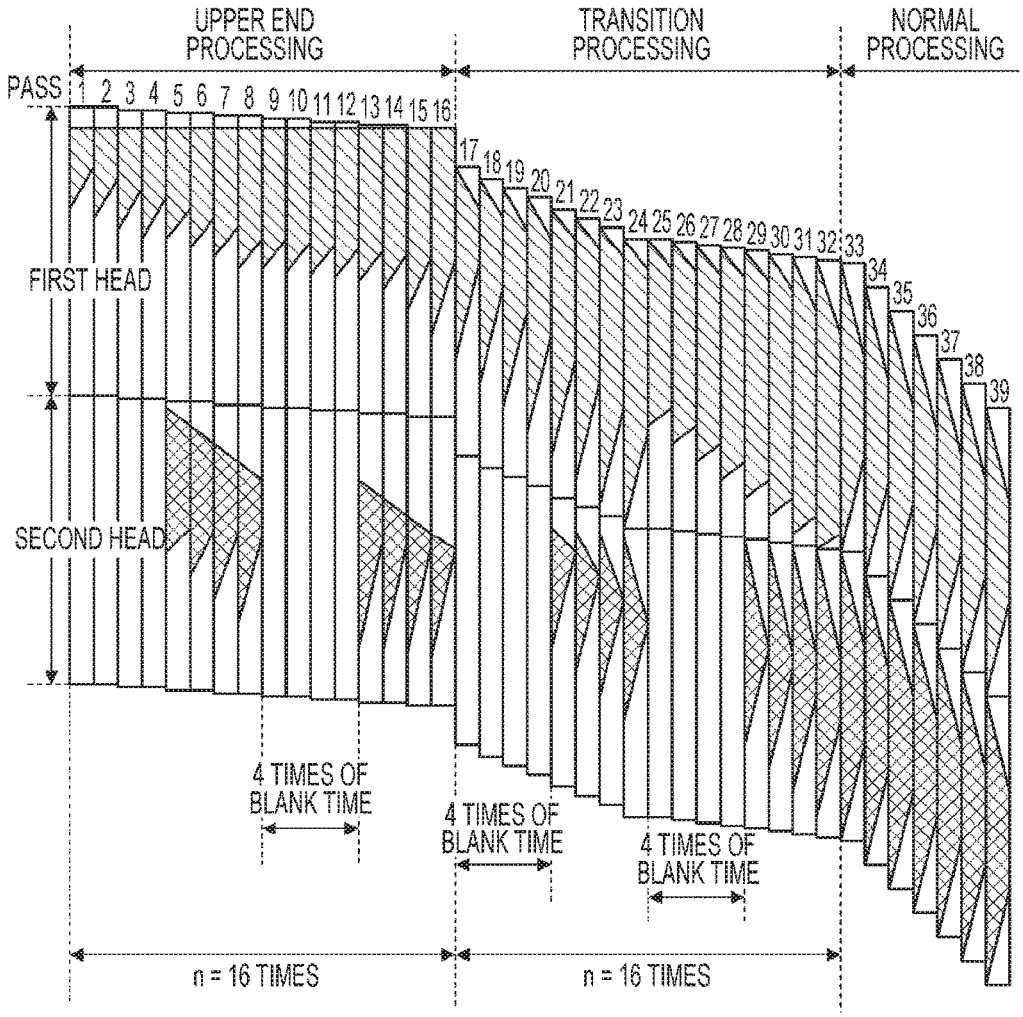
FIG. 16 is a graph which denotes a transition of respective use rates of a first head and a second head in example 3.

In addition, FIG. 16 is a graph which illustrates a transition of a use rate of respective heads in example 3 according to the first embodiment of the invention.

In example 3, use of the second head in pass 9 to pass 12 in the upper end processing in the related art which is illustrated in FIG. 14 is hastened in use of pass 5 to pass 8, and use of the second head in pass 25 to pass 28 in the transition processing is hastened in use of pass 21 to pass 24.

As a result, it is set so that use of four times and disuse of four times are equally repeated between pass (pass 5) at which use of the second nozzle column (second head) is started and pass (pass 29) at which continuous use is started. That is, there is no blank time of continuous pass, and no variation in blank time (the number of times m). That is, there is no blank time of 0.5n=8 times or more which are continuous, and no variation in blank time (the number of times m).

As described above, according to the liquid droplet ejecting method and the liquid droplet ejecting apparatus in the embodiment, it is possible to obtain the following effect.

In the liquid droplet ejecting method according to the embodiment, an image is formed by alternately repeating a transport operation (transport processing) in which the sheet 10 is moved in the transport direction, and a liquid droplet ejecting operation (ejecting process) of ejecting liquid droplets onto the sheet 10 while moving the first nozzle column (first head (first head 42A in example 1)) and the second nozzle column (second head (second head 42B in example 1)) in the scanning direction which intersects the transport direction in a scanning manner. In addition, when the number of times of a liquid droplet ejecting operation (pass) in which a raster which forms an image is completed is n times, in a liquid droplet ejecting operation after a liquid droplet ejecting operation in which the first nozzle column and the second nozzle column are used in one liquid droplet ejecting operation, that is, in a liquid droplet ejecting operation after a start of using the second nozzle column, the number of times in which a liquid droplet ejecting operation of not using the second nozzle column is continuous is less than 0.5n times. That is, there is no case in which a blank time of not continuously using the second nozzle column becomes a long time of a liquid droplet ejecting operation of 0.5n times or more. In addition, there is no variation in length of a blank time. As a result, it is possible to suppress printing unevenness which occurs due to a difference in degree of dryness, since the degree of dryness of ejected liquid droplets during a blank time is reduced.

In addition, the invention is not limited to the above described embodiment, and it is possible to add various changes, improvements, or the like, to the above described embodiment. Modification examples will be described below. Here, the same configuration elements as those in the above described embodiment will be given the same reference numerals, and redundant descriptions will be omitted.

Modification Example 1

Figure 17:
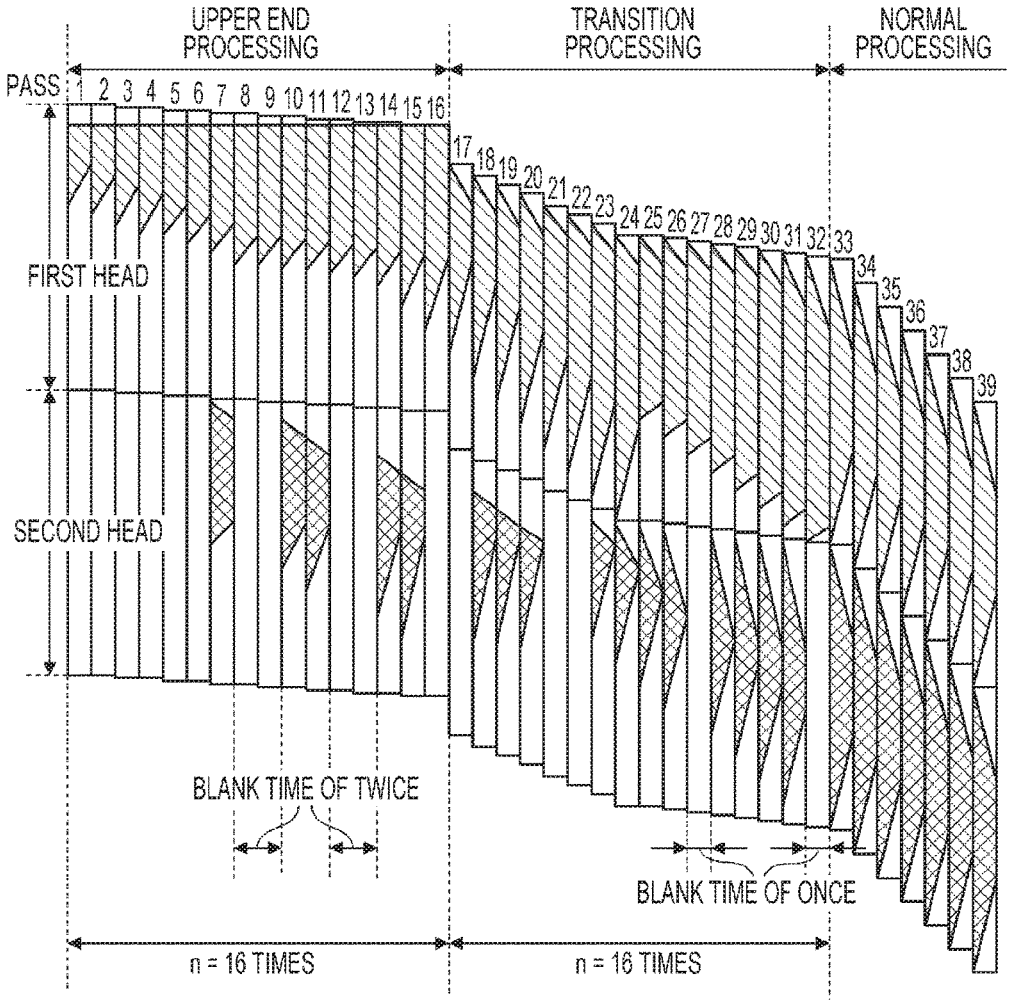
FIG. 17 is a graph which denotes a transition of respective use rates of a first head and a second head in modification example 1.

FIG. 17 is a graph which illustrates a transition of a use rate of respective heads in a liquid droplet ejecting method according to modification example 1.

In the first embodiment, as illustrated in FIGS. 13, 15, and 16, cases in which dispersed blank times (the number of times m of liquid droplet ejecting operation in which second nozzle column is not continuously used) are respectively once (examples 1 and 2), and four times (example 3), and a case in which there is no difference have been described as examples; however, respective blank times (the number of times m) which are dispersed may have no difference.

Modification example 1 is a modification example of the embodiment (example 2) with respect to the related art which is described in FIG. 14. That is, it is a modification example in a case in which one raster is formed using pass of n=16 times, using two nozzle columns (first and second heads) which are configured of 96 nozzles.

In modification example 1, banding is rarely visualized by gradually increasing the number of continuous use of the second head to once, twice, three times, and four times between the first use of the second head in a region of the upper end processing and continuous use in a region of continuous processing, and by gradually decreasing the blank time (the number of times m) to two passes, one pass, and no blank time.

When there is a large difference (variation) in respective blank times which are dispersed, there is a case in which banding is slightly viewed even when respective blank times are less than 0.5n times. Therefore, the difference is controlled so as to be $(m1-m2)/m0<1$ when a mean value, a maximum value, and a minimum value of the number of times m of the liquid droplet ejecting operation in which the second nozzle column is not used continuously are set to m0, m1, and m2. In the example illustrated in FIG. 17, m0=1.67, m1=2, and m2=1, and $(m1-m2)/m0=0.6$. That is, a change thereof is restrained so that there is no case in which the difference in the number of times m in which the second nozzle column is not used continuously, exceeds the mean value m0 of the number of times m at most. As a result, since a difference (variation) in blank time (the number of times m) in which the second nozzle column is not used continuously, is reduced, and a difference in degree of dryness of ejected liquid droplets during the blank time is reduced, it is possible to further suppress printing unevenness which occurs due to the difference in degree of dryness.

Second Embodiment

Hereinafter, a liquid droplet ejecting apparatus and a liquid droplet ejecting method as examples of an embodiment (example 4) in which the invention is embodied will be described. In addition, in example 4, a method in which banding (unevenness) in a region of transition processing to the upper end and lower end regions is described. In addition, the liquid droplet ejecting apparatus is the same as the ink jet printer 100 according to the first embodiment which is described with reference to FIGS. 1 to 12. Accordingly, descriptions of <basic configuration of ink jet printer>, <configuration of head>, <denoting method of nozzle column and nozzle>, and <dot forming method using normal processing> which are the same will be omitted by giving the same reference numerals, and the liquid droplet ejecting method which is different will be mainly described.

Similarly to the first embodiment, the ink jet printer 100 performs transition processing to upper end processing and normal processing in printing in the upper end region of a sheet 10. In addition, since the upper end processing is the same as the example in the first embodiment in which FIG. 12 is referred to, descriptions here are omitted.

In addition, in the second embodiment, a controller 60 can prints an image which is configured of a plurality of dots which are formed by ink droplets on the sheet 10 by combining a "transport operation (transport processing) of moving the sheet 10 in the transport direction, a "scanning operation (scanning processing)" of moving a head 41 in a scanning manner, an "ejecting operation" of ejecting ink as liquid droplets onto the sheet 10 from the head 41 which is performed simultaneously with the scanning operation, and a "non-ejecting operation (non-ejecting processing)" of providing an interval of a predetermined time in the ejecting operation. In addition, in this case, the scanning operation is referred to as "pass", and pass of nth time is referred to as "pass n".

Figure 18:
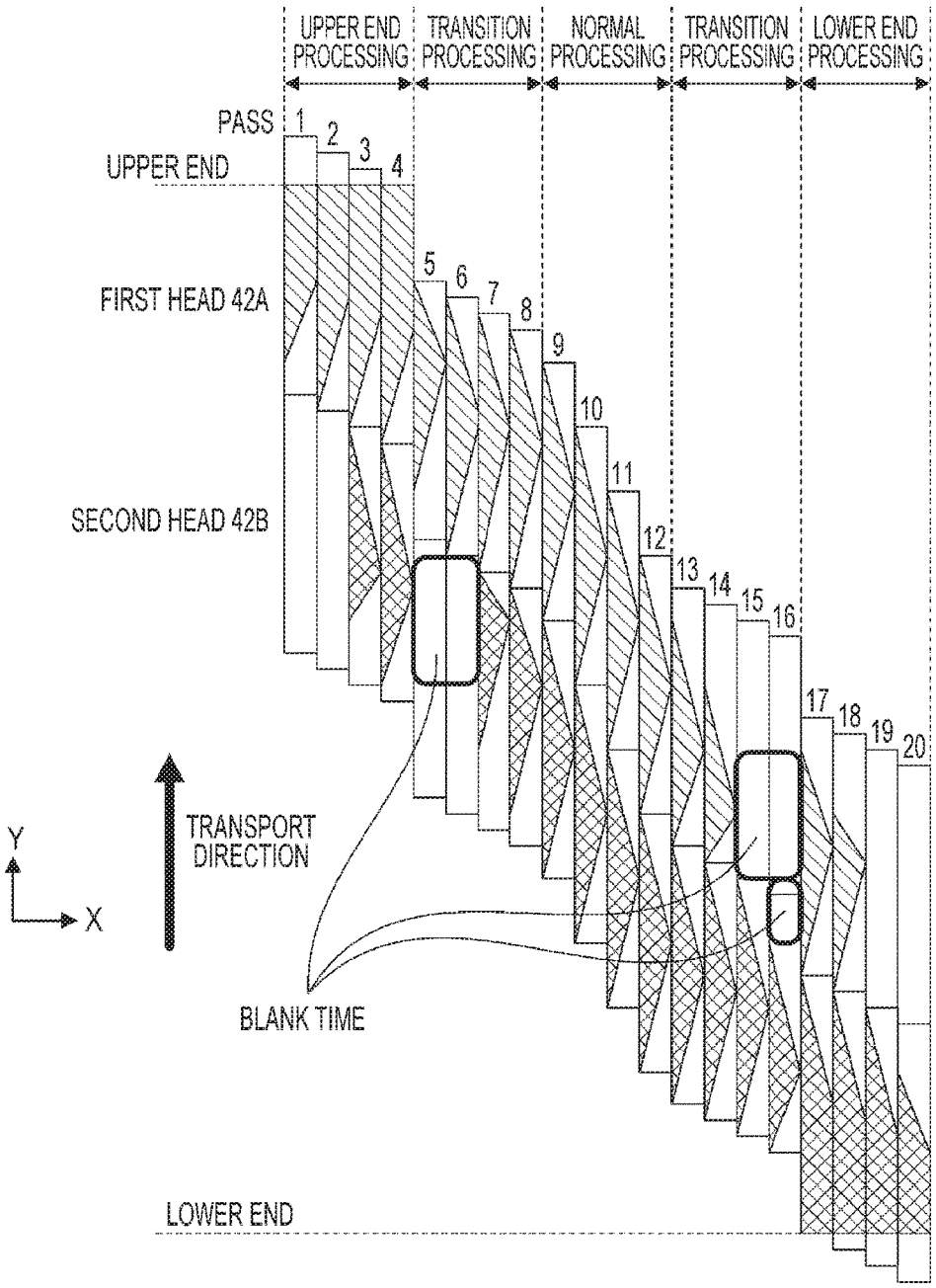
FIG. 18 is a graph which denotes a transition of a use rate of a head when including lower end processing according to a second embodiment.

FIG. 18 is a graph which illustrates a transition of a head use rate in a different example when also including lower end processing similarly.

Also in the lower end processing, since it is configured so that a use rate of the first head 42A is gradually reduced similarly to the above described upper end processing, for example, even when there is a difference between properties of the first head 42A and the second head 42B, the changes becomes smooth.

However, as illustrated in FIG. 18, in order to make a change in use rate of the first head 42A and the second head 42B smooth, a blank time (portions of pass 15 and pass 16) is generated in ejecting of ink droplets using the first head 42A, similarly, also in transition processing to the lower end region, in addition to a transition region (portions of pass 5 and pass 6) from the upper end region.

Subsequently, a method of reducing banding (unevenness) in a region of transition processing to such an upper end region and a lower end region will be described.

Figure 19:
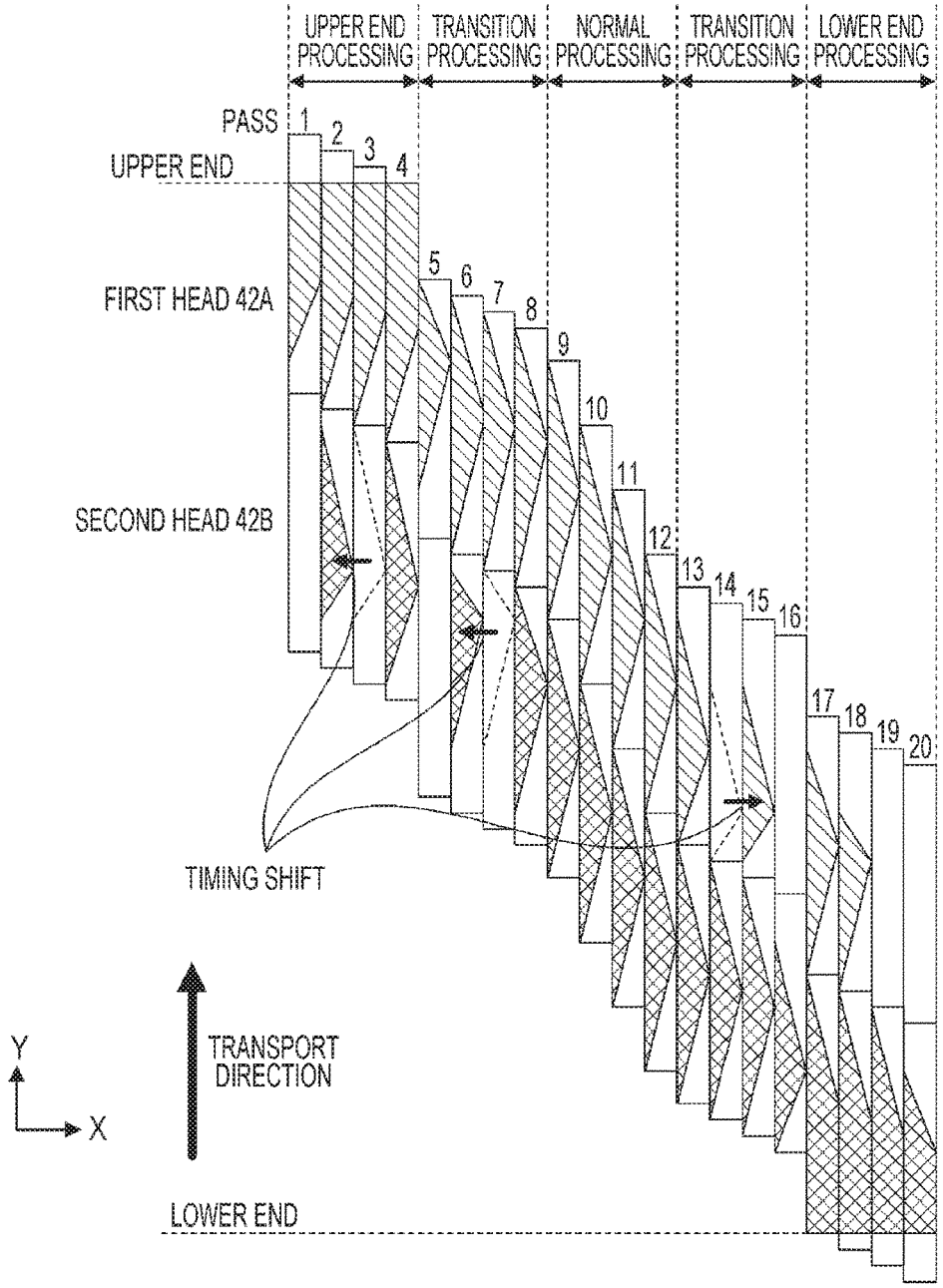
FIG. 19 is a graph which denotes a transition of a use rate of a head in which banding (unevenness) in the related art is reduced.

FIG. 19 is a graph which illustrates a transition of a head use rate in which the banding (unevenness) is reduced.

As illustrated in FIG. 19, a use of the second head 42B in pass 3 is shifted to pass 2, a use of the second head 42B in pass 7 is shifted to pass 6, and a use of the first head 42A in pass 14 is shifted to pass 15, respectively. By doing so, it is possible to disperse blank times of two passes of pass 5 and pass 6, and pass 15 and pass 16 to one pass, respectively. As a result, there is no blank time of pass which is continuous, and it is possible to reduce banding (unevenness) since a difference in drying time of ink droplets is reduced.

However, also in the method in which such a continuous blank time is dispersed by being divided, there is a case in which banding (unevenness) is easily visualized. Specifically, the continuous blank time in pass 15 and pass 16 illustrated in FIG. 18 is improved by being divided into pass 14 and pass 16 illustrated in FIG. 19; however, in pass and pass 18, the first head 42A is continuously used again, similarly to the normal processing region. As a result, a region which is interposed between regions to pass 13 and passes 17 and 18 becomes a region which is interposed between regions in which the first head 42A is continuously used, and as a result, the region is easily visualized as banding (unevenness).

In the first embodiment of the invention, the problem is improved using a method (examples 1 and 2) which will be described below.

Lower End Processing in the Embodiment

Example 4

Figure 20:
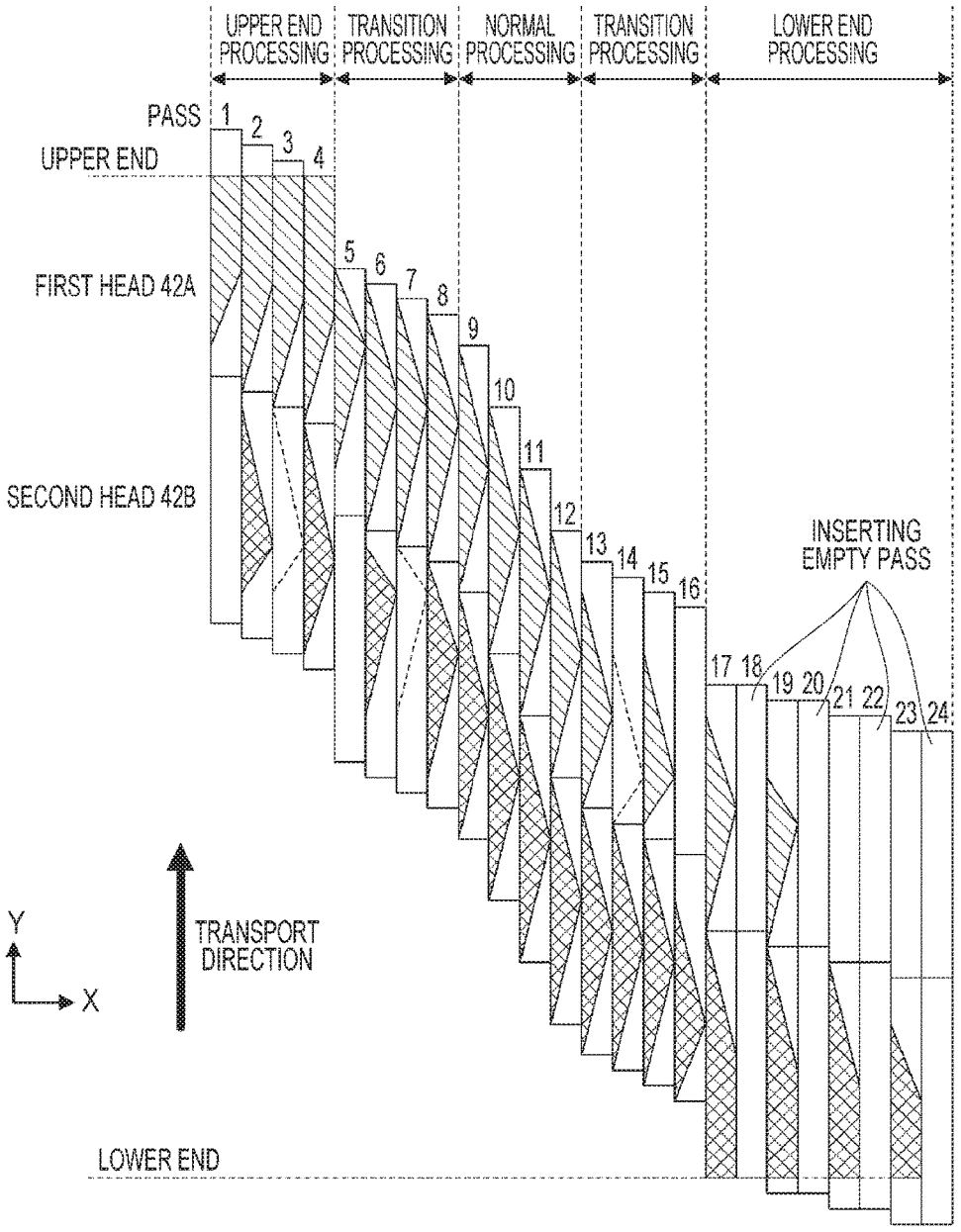
FIG. 20 is a graph which denotes a transition of respective use rates of a first head and a second head in example 4 according to the second embodiment.

FIG. 20 is a graph of example 4 which illustrates a transition of a head use rate of the respective first head 42A and second head 42B which are provided in the ink jet printer 100 according to the first embodiment. A liquid droplet ejecting method as an example of an embodiment (example 4) in which the invention is embodied will be described with reference to FIG. 20.

As described above, the controller 60 which is provided in the ink jet printer 100 prints an image configured of a plurality of dots which are formed by ink droplets on a sheet 10 by combining a "transport operation (transport processing)" which moves the sheet 10, a "scanning operation (scanning processing)" which moves a head 41 in a scanning manner, an "ejecting operation (ejecting processing)" which ejects ink droplets onto the sheet 10 which is performed simultaneously with the scanning operation, and a "non-ejecting operation (non-ejecting processing)" which provides an interval of a predetermined time to the ejecting operation.

The non-ejecting operation is an operation for providing an interval to the ejecting operation using continuous pass from the head 41, and specifically, in which a scanning operation with no ejecting operation (hereinafter, referred to as empty pass) is performed. That is, a state in which ink is not ejected is continued during a time in which the head 41 moves in the scanning direction of one direction (for example, outward path), and an interval is provided in the ejecting operation.

FIG. 20 illustrates a state in which an interval is provided using empty pass. In the lower end processing, empty pass is inserted at a timing of pass 18, pass 20, pass 22, and pass 24. As a result, an interval of one pass is provided in a continuous use (refer to FIG. 19) of the first head 42A in pass 17 and pass 18, and a state in which ejecting of ink droplets of the first head 42A after pass 13 is performed in every other pass is continued. That is, a degree of banding (unevenness) which is visualized in a state in which the ejecting state is continued again is reduced. In addition, the reason for inserting empty pass in pass 20 and pass 22 is to prevent a situation in which banding (unevenness) is visualized which is caused when an interval also occurs in the use of the second head 42B by inserting empty pass in pass 18, and the situation is continued. In addition, the reason for setting pass 24 to empty pass is to set so that there is no change in position of the head 41 when printing is finished (in order to cause head 41 to return to home position), by setting the number of times of empty pass to be inserted to an even number.

As described above, according to the liquid droplet ejecting method and the liquid droplet ejecting apparatus according to the example, it is possible to obtain the following effects.

The liquid droplet ejecting method according to the embodiment include a transport operation in which the sheet 10 is moved in the transport direction, a scanning operation in which a plurality of nozzle columns (first head 42A and second head 42B) in which a plurality of nozzles are aligned in the transport direction are moved in the scanning direction which intersects the transport direction, an ejecting operation in which liquid droplets are ejected onto the sheet 10 from the nozzle column, which is performed simultaneously with the scanning operation, and a non-ejecting operation which provides an interval of a predetermined time between ejecting operations of two times, and in which an image is formed by combining the ejecting operation and the non-ejecting operation. By combining the non-ejecting operation, it is possible to control an interval of the ejecting operation in which ink droplets are ejected. That is, it is possible to perform a control so that a difference in time in which ink droplets which are ejected onto the sheet 10 are dried, or a degree of change thereof is reduced. As a result, it is possible to suppress printing unevenness which is caused by the difference in degree of dryness.

In addition, the non-ejecting operation is a scanning operation with no ejecting operation. For this reason, it is possible to conveniently execute a non-ejecting operation using a control of not performing an ejecting operation without stopping the ejecting operation.

In addition, the ink jet printer 100 includes the transport unit 20 which moves the sheet 10 in the transport direction, the first head 42A and the second head 42B which eject ink droplets onto the sheet 10, and the carriage unit 30 which moves the first head 42A and the second head 42B in the scanning direction which intersects the transport direction in a scanning manner. The ink jet printer 100 includes a transport operation in which the sheet 10 is moved in the transport direction, a scanning operation in which the first head 42A and the second head 42B are moved in the scanning direction in a scanning manner, an ejecting operation in which ink droplets are ejected onto the sheet 10 from the first head 42A and/or the second head 42B, which is performed simultaneously with the scanning operation, and a non-ejecting operation which provides an interval of a predetermined time between ejecting operations of two times, and in which an image is formed by combining the ejecting operation and the non-ejecting operation. By combining the non-ejecting operation, it is possible to control an interval of the ejecting operation in which ink droplets are ejected. That is, according to the ink jet printer 100, it is possible to perform a control so that a difference in time in which ink droplets which are ejected onto the sheet 10 are dried, or a degree of change thereof is reduced. As a result, it is possible to perform printing in which printing unevenness which is caused by the difference in degree of dryness is suppressed.

Example 5

Figure 21:
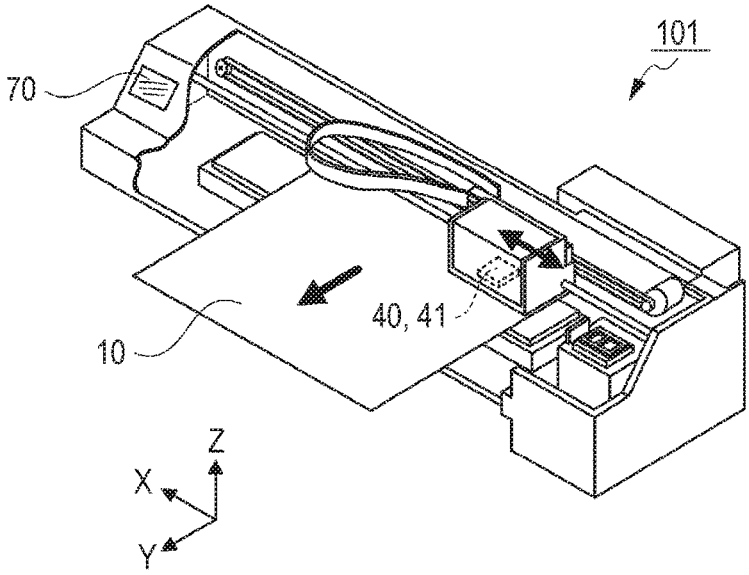
FIG. 21 is a perspective view which illustrates an ink jet printer as a liquid droplet ejecting apparatus in example 5 according to the second embodiment.

FIG. 21 is a perspective view which illustrates an ink jet printer 101 according to example 5 in the embodiment.

The ink jet printer 101 includes a display panel 70 for notifying an operation state of the ink jet printer 101. The display panel 70 is, for example, a liquid crystal display panel, and as illustrated in FIG. 21, the display panel is provided on the front face of a housing of the ink jet printer 101. An operation state of the ink jet printer 101 is grasped by a controller 60, and a display corresponding to the state is performed in the display panel 70.

In addition, the ink jet printer 101 performs a "non-ejecting operation" as an operation of stopping a scanning operation, and displays a state in which the ink jet printer 101 performs a non-ejecting operation during a non-ejecting operation on the display panel 70.

Except for the above described points, the ink jet printer 101 is the same as the ink jet printer 100. Specific descriptions will be made below.

In example 4, the non-ejecting operation is performed using a scanning operation (empty pass) with no ejecting operation. In contrast to this, in example 5, an interval is provided to an ejecting operation using continuous passes from the head 41. A standby state in which the carriage unit 30 is not driven is inserted between pass 17 and pass 18, between pass 18 and pass 19, and between pass 19 and pass 20 in FIG. 19. Accordingly, the graph which illustrates a transition of a head use rate is the same as the graph which is illustrated in FIG. 20.

In addition, a predetermined standby time is equal to a time which is necessary for one pass; however, it is not limited to this. It is preferable to appropriately set the predetermined standby time by evaluating a degree in which visualized banding (unevenness) is reduced.

A timing for stopping a scanning operation, and causing the scanning operation to be on standby is not limited to a range of the lower end processing. For example, it may be a method in which, in a range from normal processing to transition processing, and in a range of the transition processing, a standby time between each of passes is gradually increased, and the standby time is smoothly changed until a standby time of being inserted into a region of the lower end processing.

A display of "in the middle of a non-ejecting operation" on the display panel 70 is performed, for example, by displaying wording such as "process is transferred to a lower end printing mode of a printing sheet", or the like, using blinking.

In the liquid droplet ejecting method and the liquid droplet ejecting apparatus according to the embodiment, it is possible to obtain the following effects.

The non-ejecting operation is an operation for stopping a scanning operation. For this reason, it is possible to flexibly set a predetermined time in which a scanning operation is stopped, and as a result, it is possible to further flexibly and appropriately set an interval of an ejecting operation of ejecting liquid droplets.

In addition, since performing of a non-ejecting operation in the middle of a non-ejecting operation is displayed on the display panel 70, it is possible to further easily recognize that an operation of not ejecting ink droplets is a predetermined operation. That is, for example, it is easily recognized that non-ejecting is not caused by a failure of the ink jet printer 101, and there is no case of giving an uneasy feeling to a user.

Notifying of performing of a non-ejecting operation in the middle of a non-ejecting operation is not limited to a display on the display panel 70. For example, it may be a method of expressing a normal operation using a pilot lamp, or the like. In addition, there is no limitation in displaying, and it may be a display using, for example, notification sound such as a melody or a buzzer.

Other Embodiments

In the above described embodiment, the ink jet printer is described; however, the descriptions include disclosures of a printing apparatus, a recording apparatus, a liquid ejecting apparatus, a printing method, a recording method, a liquid ejecting method, a printing system, a recording system, a computer system, a program, a storage medium in which a program is stored, a display screen, a screen display method, a manufacturing method of a printed matter, and the like.

In addition, the ink jet printer as the embodiment has been described as an example; however, the above described embodiment is for understanding the invention, and is not for limiting the invention. The invention can be modified, and improved without departing from the scope of the invention, and it is needless to say that the invention includes equivalents thereof. Particularly, embodiments which will be described below are also included in the invention.

Regarding Printer

In the above described embodiment, an ink jet printer has been described; however, there is no limitation to this. The same technology as the embodiment may be applied to various liquid ejecting apparatuses to which an ink jet technology is applied, such as, a color filter manufacturing device, a dyeing device, a fine machining device, a semiconductor manufacturing device, a surface machining device, a three-dimensional molding machine, a liquid vaporization device, an organic EL manufacturing device (particularly, high polymer EL manufacturing device), a display manufacturing device, a film forming device, and a DNA chip manufacturing device, for example. In addition, these methods or manufacturing methods are also included in the application range. Since it is possible to directly eject (direct drawing) liquid toward a target by applying the technology to such fields, it is possible to perform high quality printing, recording, image forming, or the like, compared to the related art.

Regarding Ink

Since the above described embodiment is for an ink jet printer, liquid droplets which are ejected have been described as ink. However, liquid ejected from nozzles is not limited to ink. The liquid may be liquid (also including water) containing, for example, a metallic material, an organic material (in particular, high polymer material), a magnetic material, a conductive material, a film forming material, electronic ink, machining liquid, gene solution, or the like.

Regarding Method of Head

In the above described embodiment, an example in which a piezoelectric element is used as a driving element for ejecting ink droplets has been described; however, the method of a head is not limited to this, and may be another printing (recording) method in which ink is discharged in a liquid droplet shape, and dot groups are formed on a printing (recording) medium. For example, the method may be a method in which recording is performed by continuously discharging ink in a liquid droplet shape from a nozzle using an intense electric field between a nozzle and an acceleration electrode which is placed in front of the nozzle, and applying a printing information signal from a deflection electrode while ink droplets are flying, a method of discharging ink droplets by corresponding to a printing information signal without deflecting the ink droplets (electrostatic suctioning method), a method in which ink droplets are forcibly discharged by applying a pressure to ink using a small pump, and mechanically vibrating nozzles using a crystal vibrator, or the like, a method in which ink is subjected to heating foaming using a microelectrode according to a printing information signal, and recording is performed by ejecting ink droplets (thermal jet method), or the like.

Regarding the Number of Heads

In the above described embodiment, the number of heads which configures the head set is two; however, it may be three or more. Even if the number of heads is set to three or more, in a case of performing upper end processing or lower end processing, or a case of performing upper end processing or normal processing and lower end processing, an upper end region which is formed using only one head, or a normal region in which dots are formed using a plurality of heads is present. In addition, also in a case in which the number of heads is three or more, when the same processing as that in the above described is performed, unevenness due to banding becomes rarely noticeable.

Regarding Apparent Nozzle Arranging Direction

In the invention, the "nozzle arranging direction" is not necessarily limited to a direction in which ejecting ports which are physically formed are arranged.

For example, in a case in which a pitch of adjacent ejecting ports is shortly arranged with respect to a diameter of an opening of the ejecting port (located at the front and the rear in column), or the like, there is a case in which nozzles are obliquely arranged. When nozzles are obliquely arranged, it is possible to configure so that nozzles are aligned in the Y axis direction apparently, by shifting a timing of ejecting ink with respect to a scanning speed in the X axis direction using the carriage unit 30. For example, for an ejecting port which is arranged at a position which is shifted by a length d in the scanning direction, it is possible to correct the shift by delaying or advancing an ejecting timing by td (=d/scanning speed).

Also in such a case, that is, in a case in which nozzles are arranged in the Y axis direction, virtually, not physically, it can be similarly understood as the "direction in which nozzles are arranged".

The entire disclosures of Japanese Patent Application Nos. 2015-055785 filed Mar. 19, 2015 and 2015-059150, filed Mar. 23, 2015 are expressly incorporated by reference herein.

What is claimed is:

1. A liquid droplet ejecting method comprising:

forming an image which is configured by a unit of image which is completed using liquid droplet ejecting operations of n times by repeating a plurality of times of a transport operation in which a printing medium is moved in a transport direction and a liquid droplet ejecting operation in which liquid droplets are ejected on the printing medium while moving a first nozzle column which includes a plurality of nozzles which are aligned in the transport direction, and eject liquid droplets, and a second nozzle column which aligns on the upstream side of the first nozzle column in the transport direction, and includes a plurality of nozzles which are aligned in the transport direction, and eject liquid droplets in a scanning direction which intersects the transport direction in a scanning manner, wherein the number of times m, in which the liquid droplet ejecting operation in which the second nozzle column is not used is continuously executed after executing the liquid droplet ejecting operation once using the first nozzle column and the second nozzle column, is less than 0.5n.

2. The liquid droplet ejecting method according to claim 1, wherein $(m1-m2)/m0<1$ is satisfied when a mean value, a maximum value, and a minimum value of the number of times m are set to m0, m1, and m2.

3. A liquid droplet ejecting method comprising:

transporting a printing medium in a transport direction;

scanning a first nozzle column and a second nozzle column in a scanning direction which intersects the transport direction, each of the first and second nozzle columns including a plurality of nozzles which selectively eject liquid droplets, the first and second nozzle columns being located at different positions along the transport direction;

an ejecting mode during which liquid droplets are ejected from the first nozzle column and the second nozzle column; and a non-ejecting mode during which liquid droplets are not ejected from at least one of the first nozzle column or the second nozzle column, wherein when the non-ejecting mode is designated to be executed two consecutive times in a first period, a timing of the ejecting mode is altered from being executed directly adjacent to the first period to a modified timing wherein the non-ejecting mode and the ejecting mode are alternatively executed within the first period.

4. The liquid droplet ejecting method according to claim 3, wherein the non-ejecting mode is executed only for a time period during which execution of the scanning is performed.

5. The liquid droplet ejecting method according to claim 3, wherein the non-ejecting mode is executed during execution of the scanning.

6. The liquid droplet ejecting method according to claim 3, wherein, in the non-ejecting mode, the liquid droplets are not ejected from the first nozzle column and are not ejected from the second nozzle column.

7. The liquid droplet ejecting method according to claim 3, wherein a notice is provided that a predetermined operation is being executed during execution of the non-ejecting mode.

8. A liquid droplet ejecting apparatus comprising:

a transport unit which moves a printing medium in a transport direction;

a first nozzle column which includes a plurality of nozzles which align in the transport direction, and eject liquid droplets;

a second nozzle column which aligns on the upstream side of the first nozzle column in the transport direction, and includes a plurality of nozzles which align in the transport direction, and eject liquid droplets; and a scanning movement unit which moves the first nozzle column and the second nozzle column in a scanning direction which intersects the transport direction in a scanning manner, wherein an image configured of a raster which is completed using liquid droplet ejecting operations of n times is formed, by alternately repeating a transport operation in which the printing medium is moved in the transport direction, and a liquid droplet ejecting operation in which liquid droplets are ejected onto the printing medium while causing the first nozzle column and the second nozzle column to be moved in a scanning manner, and wherein, in the liquid droplet ejecting operation after the liquid droplet ejecting operation in which the first nozzle column and the second nozzle column are used in the liquid droplet ejecting operation of one time, the number of times m, in which the liquid droplet ejecting operation in which the second nozzle column is not used is continuous, is less than 0.5n.

9. A liquid droplet ejecting apparatus comprising:

a transport unit which moves a printing medium in a transport direction;

a first nozzle column and a second nozzle column which are located at different positions along the transport direction, each of the first and second nozzle columns including a plurality of nozzles which selectively eject liquid droplets;

a scanning movement unit which moves the first nozzle column and the second nozzle column in a scanning direction which intersects the transport direction; and a control unit which is configured to control ejecting and non-ejecting of liquid droplets from the first nozzle column and the second nozzle column, wherein the control unit is configured to cause the first nozzle column and the second nozzle column to eject liquid droplets along with a movement of the first nozzle column and the second nozzle column in one direction along the scanning direction using the scanning movement unit, the control unit is configured to cause the plurality of nozzles of at least one of the first nozzle column and the second nozzle column to be in an ejecting state in which liquid droplets are elected and in a non-ejecting state in which liquid droplets are not ejected, and when the non-ejecting state is designated to be executed two consecutive times in a first period, a timing of the ejecting state is altered from being executed directly adjacent to the first period to a modified timing wherein the non-ejecting state and the ejecting state are alternatively executed within the first period.

10. The liquid droplet ejecting apparatus according to claim 9, wherein the first nozzle column and the second nozzle column are included in different heads, respectively.

* * * * *